US007168782B2

(12) United States Patent
Koitabashi et al.

(10) Patent No.: US 7,168,782 B2
(45) Date of Patent: Jan. 30, 2007

(54) RECORDING APPARATUS AND METHOD

(75) Inventors: Noribumi Koitabashi, Yokohama (JP); Masataka Yashima, Kita-ku (JP); Tsuyoshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/104,604

(22) Filed: Apr. 13, 2005

(65) Prior Publication Data

US 2005/0174384 A1 Aug. 11, 2005

Related U.S. Application Data

(62) Division of application No. 09/845,498, filed on May 1, 2001, now Pat. No. 6,908,176.

(30) Foreign Application Priority Data

May 1, 2000 (JP) ..... 2000/132174
Apr. 23, 2001 (JP) ..... 2001/124239

(51) Int. Cl.
*B41J 29/393* (2006.01)

(52) U.S. Cl. ..... 347/19; 347/15

(58) Field of Classification Search ..... None
See application file for complete search history.

(56) References Cited

U.S. PATENT DOCUMENTS

| | | | | |
|---|---|---|---|---|
| 4,313,124 | A | 1/1982 | Hara | 346/140 R |
| 4,345,262 | A | 8/1982 | Shirato et al. | 346/140 R |
| 4,459,600 | A | 7/1984 | Sato et al. | 346/140 R |
| 4,463,359 | A | 7/1984 | Ayata et al. | 346/1.1 |
| 4,558,333 | A | 12/1985 | Sugitani et al. | 346/140 R |
| 4,608,577 | A | 8/1986 | Hori | 346/140 R |
| 4,723,129 | A | 2/1988 | Endo et al. | 346/1.1 |
| 4,740,796 | A | 4/1988 | Endo et al. | 346/1.1 |
| 5,581,284 | A | 12/1996 | Hermanson | 347/43 |
| 5,992,972 | A | 11/1999 | Nagoshi et al. | 347/43 |
| 6,130,685 | A | 10/2000 | Matsubara et al. | 347/41 |
| 6,164,747 | A | 12/2000 | Yashima et al. | 347/15 |
| 6,260,939 | B1 | 7/2001 | Shioya et al. | 347/15 |
| 6,270,187 | B1 | 8/2001 | Murcia et al. | 347/43 |

FOREIGN PATENT DOCUMENTS

| | | |
|---|---|---|
| EP | 0559370 | 9/1993 |
| EP | 0783973 | 7/1997 |
| EP | 0855270 | 7/1998 |
| EP | 0914954 | 5/1999 |
| EP | 0963854 | 12/1999 |
| EP | 0974467 | 1/2000 |
| EP | 0983855 | 3/2000 |
| JP | 54-56847 | 5/1979 |
| JP | 59-123670 | 7/1984 |
| JP | 59-138461 | 8/1984 |
| JP | 60-71260 | 4/1985 |

*Primary Examiner*—Thinh Nguyen
(74) *Attorney, Agent, or Firm*—Fitzpatrick, Cella, Harper & Scinto

(57) ABSTRACT

A recording apparatus for forming a color image on the recording material. The recording apparatus includes a recording head having a plurality of recording elements; recording head driving units for driving the recording elements of the recording head in accordance with image data to form an image on the recording material; a plurality of supplementing units for effecting supplementations, in different manners, for supplementing defects in a recorded image resulting from a non-operating recording element of the recording elements; and control units for selectively operating the plurality of supplementing units depending on a record image to effect the supplementation.

6 Claims, 24 Drawing Sheets

FIG. 1A
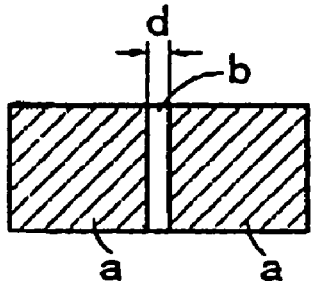
FIG. 1B
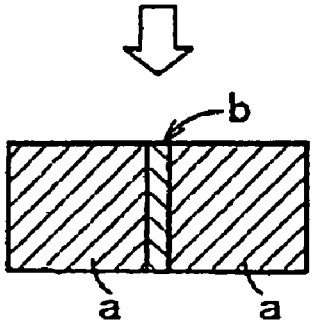
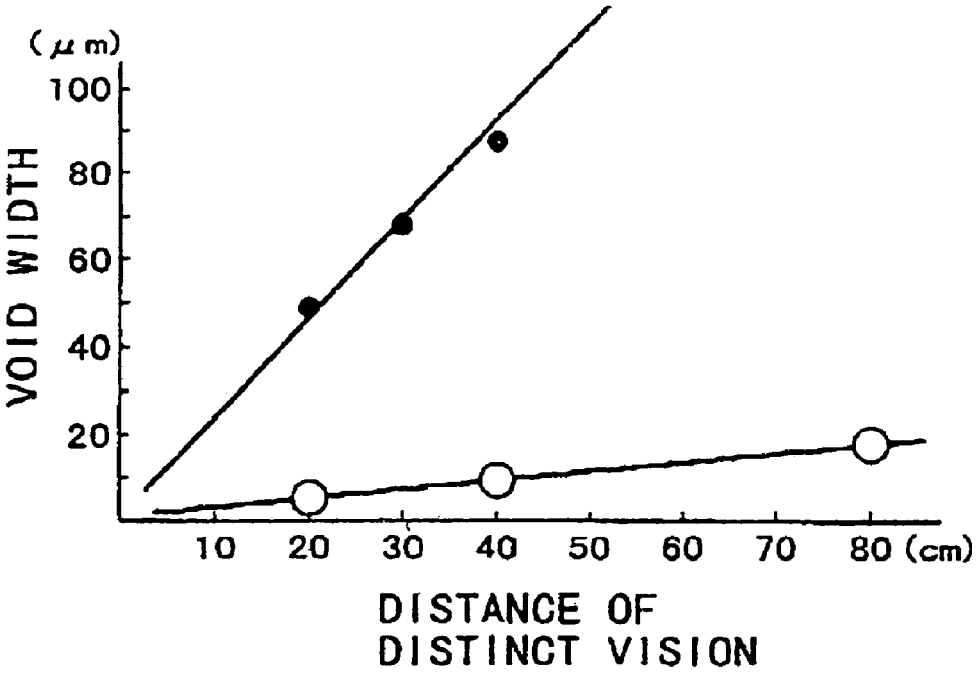
FIG. 1C $$AVE = \frac{1}{128}\sum^{i} n(i)$$

$$ave(i) = \{n(i-1)+n(i)+n(i-1)\}/3$$

RECORDING APPARATUS AND METHOD

This application is a division of application Ser. No. 09/845,498, filed May 1, 2001 now U.S. Pat. No. 6,908,176, the entire disclosure of which is incorporated herein by reference.

FIELD OF THE INVENTION AND RELATED ART

The present invention relate to a recording apparatus which records with the use of a recording head having a plurality of recording element arranged in a predetermine pattern, and a recording method used with such a recording apparatus. In particular, the present invention relates to an ink jet recording apparatus which has a recording head having a plurality of nozzles arranged in a predetermined pattern, and records by ejecting ink from the plurality of nozzles.

An ink jet recording apparatus which records on recording medium by ejecting ink from the nozzles arranged in the recording head has recently come to be used in a wide range of apparatus, for example, a printer, a facsimile machine, a copying machine, and the like. Also, in recent years, an ink jet recording apparatus has been remarkably improved in image quality, and therefore, its usage is dramatically growing in the field of a color printer capable of recording a color image with the use of a plurality of inks different in color. Obviously, image quality is one of the important aspects of the performance of a recording apparatus. Another important aspect of the recording apparatus performance is recording speed. Thus, in order to increase the recording speed of an ink jet recording apparatus, not only has the frequency at which a recording head is driven to eject ink been increased, but also the number of the nozzles arranged in a recording head has been increased.

However, an ink jet head sometimes suffers from a symptom called "ejection failure." In other words, an ink jet head sometimes fails to eject ink. There are many causes why an ink jet head fails to eject. Some of the causes are foreign objects which entered a nozzle or nozzles of a recording head during the manufacturing of the head, and deterioration of nozzles and/or elements for ejecting ink, which occurs as usage time of a recording head accumulates. In the cases of the latter causes, it is possible that ejection failure might unexpectedly occur while a recording apparatus is in use.

In addition, sometimes, an ejection failure may not be a complete failure. For example, although ink is ejected, the direction in which ink is ejected may be substantially different from the predetermined one (which hereinafter may he referred to as "deviant ejection"), or the volume of an ink droplet may be substantially different from the predetermined one (which hereinafter may be referred to as "link droplet diameter deviation"). Such a condition of a given nozzle as described, that is, a condition in which a given nozzle has deteriorated to a point at which it will gravely reduce image quality and should not be used for recording, will be described along with the "complete ejection failure."

In the past, ejection failure traceable to the manufacturing of a recording head was not much of a problem since the frequency of the occurrence of such a problem could be reduced by improving manufacture environment and the like. However, as the number of the nozzles arranged in a recording head is increased to increase recording speed as has been in recent years as described above, this problem becomes unignorable. Manufacturing a recording head free of a defective nozzle, or a recording head which is not likely to unexpectedly suffer from ejection failure, increases manufacturing cost, resulting in increases in recording head cost.

Occurrence of ejection failure such as the one described above results in the formation of an image having a defect such as an unwanted white line. In order to compensate for a defective or failed nozzle, a few number of technologies have been proposed. According to one of them, compensation is made for a defective or failed nozzle with the use of a normal nozzle, that is, a properly working nozzle, in such a manner that the portion of an image correspondent to the defective or failed nozzle, that is, the portion of an image which will not be recorded and remain as a white line unless the compensation is made, will be not be left as a white line. This technology depends on a recording method used by an ink jet recording apparatus, in which a given portion of a recording medium is scanned two or more times by a recording head to complete the portion of an image correspondent to this portion of the recording medium.

On the other hand, in order to increase recording speed, the so-called single pass recording method is preferable; it is desired that a given portion of an image is completed through a single scanning run by a recording head over the portion of the recording medium correspondent to the give portion of the image. However, when a recording head having a defective or failed nozzle (which hereinafter may be referred to as "bad nozzle") is used in conjunction with the so-called single pass recording method, it is next to impossible to record an image so that the portion of a recording medium correspondent to the defective or failed nozzle will be filled with the ink from a normally working nozzle in order to make the portion of the image correspondent to the bade nozzle turn out inconspicuous. Further, even in the case of the so-called multiscan recording method, that is, a recording method in which a given portion of a recording medium is subjected to two or more scanning runs of a recording head, although it depends on the position of a bad nozzle, and/or the number of bad nozzles, it is sometimes rather difficult to compensate for a bad nozzle so that the image portion correspondent to the bad nozzle will turn out inconspicuous.

SUMMARY OF THE INVENTION

The present invention was made in view of the above described technical problems, and its primary object is to provide an inexpensive high speed ink jet recording apparatus by preventing the manufacturing cost of an ink jet head from being increased by the cost for improving the quality of an ink jet itself. As a means for accomplish this object, the present invention provides a method for compensating for a bad nozzle resulting from manufacturing errors or gradual natural deterioration of an ink jet head caused by usage, in such a manner that the nonuniformity of an image resulting from an anomaly such as an unwanted white line, which would have occurred if the compensation is not made, be undetectable to the human eye.

According to an aspect of the present invention there is provided a recording apparatus for forming a color image on the recording material, comprising a recording head having a plurality of recording elements; recording head driving means for driving the recording elements of said recording head in accordance with image data to form an image on the recording material; a plurality of supplementing means for effecting supplementations, in different manners, for supplementing defects in a recorded image resulting from a non-operating recording element of said recording elements; and control means for selectively operating said plurality of supplementing means depending on a record image to effect the supplementation.

According to another aspect of the present invention there is provided a method for forming a color image on the recording material in accordance with image data, using a recording head having a plurality of recording elements, said method comprising the steps of a step of identifying non-operating recording element of the plurality of recording elements; a step of discriminating an image recorded by said recording head; a step of providing different supplementing manners for supplementing defects in a recorded image resulting from a non-operating recording element of said recording elements, selecting a supplement manner from the different supplementing manners, and effecting control in accordance with the selected manner; and a step of effecting recording with supplementation for the non-operating recording element through the selected manner.

According to a further aspect of the present invention there is provided a recording apparatus for forming a color image on the recording material with different colors, comprising a recording head having a plurality of recording elements; recording head driving means for driving the recording elements of said recording head in accordance with image data to form an image on the recording material; and supplementing means for effecting supplementation recording with a different color of the non-operating recording element and with similar lightnesses, for a recording position which is to be recorded by the non-operating recording element.

According to a further aspect of the present invention there is provided a recording method for forming a color image on the recording material with different colors, using a recording head having a plurality of recording elements, comprising the steps of a step of identifying non-operating recording element of the plurality of recording elements; a step of effecting recording in accordance with image data; and a step of effecting supplementation recording with a different color of the non-operating recording element and with similar lightnesses, for a recording position which is to be recorded by the non-operating recording element.

According to a further aspect of the present invention there is provided a recording apparatus for forming a color image on the recording material with different colors, comprising a recording head having a plurality of recording elements; recording head driving means for driving the recording elements of said recording head in accordance with image data to form an image on the recording material; and supplementing means for effecting supplementation recording with a recording element for black color recording, for a recording position corresponding to a non-operating recording element among the recording elements for non-black color recording.

According to a further aspect of the present invention there is provided a recording method for forming a color image on the recording material with different colors, using a recording head having a plurality of recording elements, comprising the steps of a step of recording an image on the recording material by driving a plurality of recording elements of said recording head in accordance with image data; and a step of effecting supplementation recording with a recording element for black color recording, for a recording position corresponding to a non-operating recording element among the recording elements for non-black color recording.

According to a further aspect of the present invention there is provided a recording apparatus for forming a color image on the recording material, comprising a recording head having a plurality of recording elements; inputting means for inputting multi-value image data indicative of an image density; correcting means for correcting image data corresponding to a recording element which is adjacent to the non-operating recording element of said plurality of recording elements; generating means for generating driving data for driving the recording elements corresponding thereto on the basis of the image data corrected by said correcting means; and recording control means for controlling the recording elements of said recording head in accordance with the driving data thus generated to effect recording.

According to a further aspect of the present invention there is provided a method for forming a color image on the recording material in accordance with image data, using a recording head having a plurality of recording elements, said method comprising the steps of a step of inputting multi-value image data indicative of an image density; a step of identifying a non-recording element of the plurality of the recording elements on the basis of a variation in densities of a test pattern recorded by said recording head; a step of correcting, on the basis of the variation of the densities, image data corresponding to respective recording elements to raise an image density of the image data for the recording element which is adjacent to the non-operating recording element; and a step of correcting, on the basis of the variation of the densities, image data corresponding to respective recording elements to raise an image density of the image data for the recording element which is adjacent to the non-operating recording element; and a step of generating driving data for driving the recording elements corresponding thereto on the basis of the image data corrected by said correcting means; a step of recording controlling the recording elements of said recording head in accordance with the driving data thus generated to effect recording.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 1A and 1B are rough drawings for showing a missing portion of a printed image, and another image printed in a manner to fill the missing portion of the image. FIG. 1C is a graph for showing the relationship between the width of the missing portion of an image and the distance beyond which the missing portion of the image cannot be detected by of the human eye.

FIG. 11 is a graph of an example of a density correction table multiplied by coefficient a.

PREFERRED EMBODIMENTS OF THE PRESENT INVENTION

Figure 2:
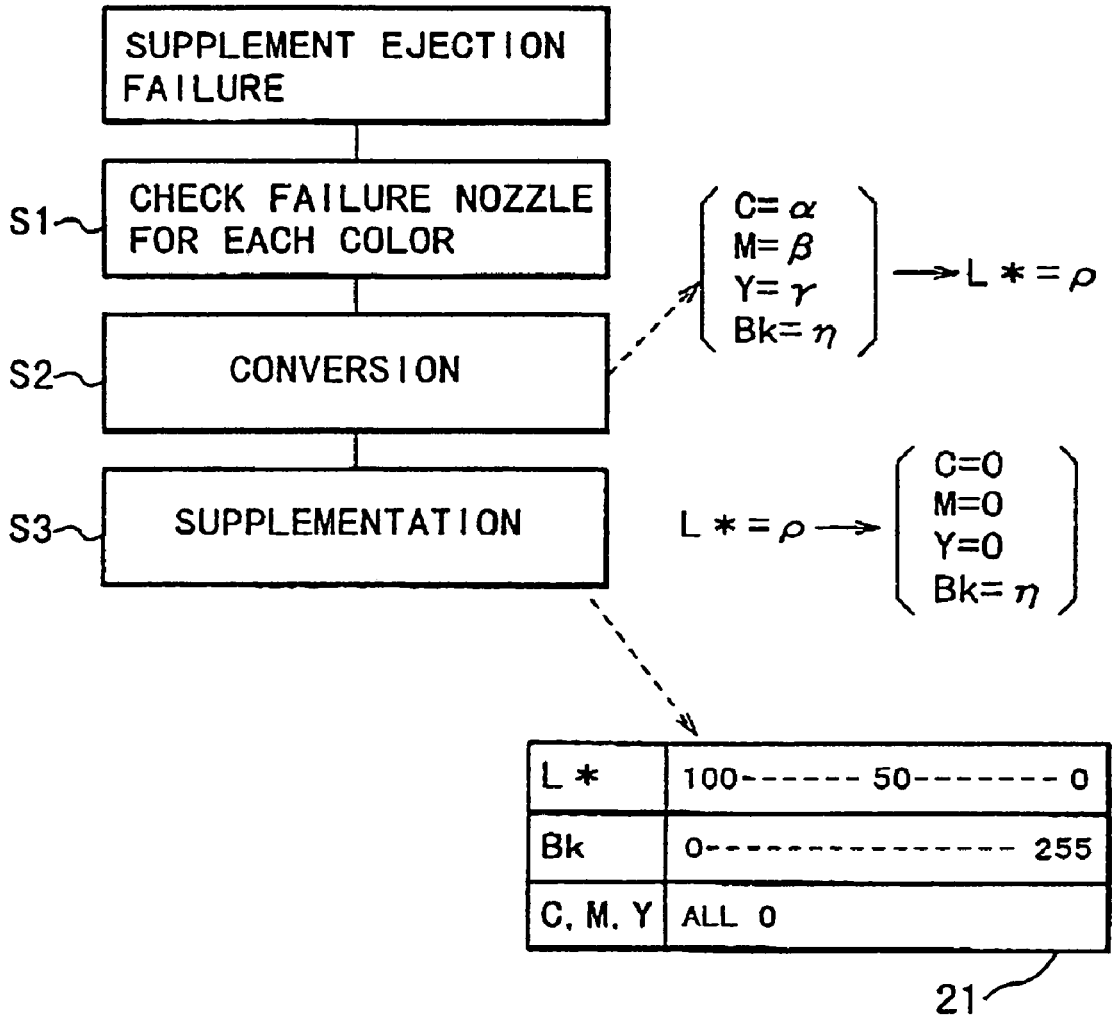
FIG. 2 is a block diagram for a method for compensating for a bad nozzle with the use of only a nozzle for black ink.
Figure 3A:
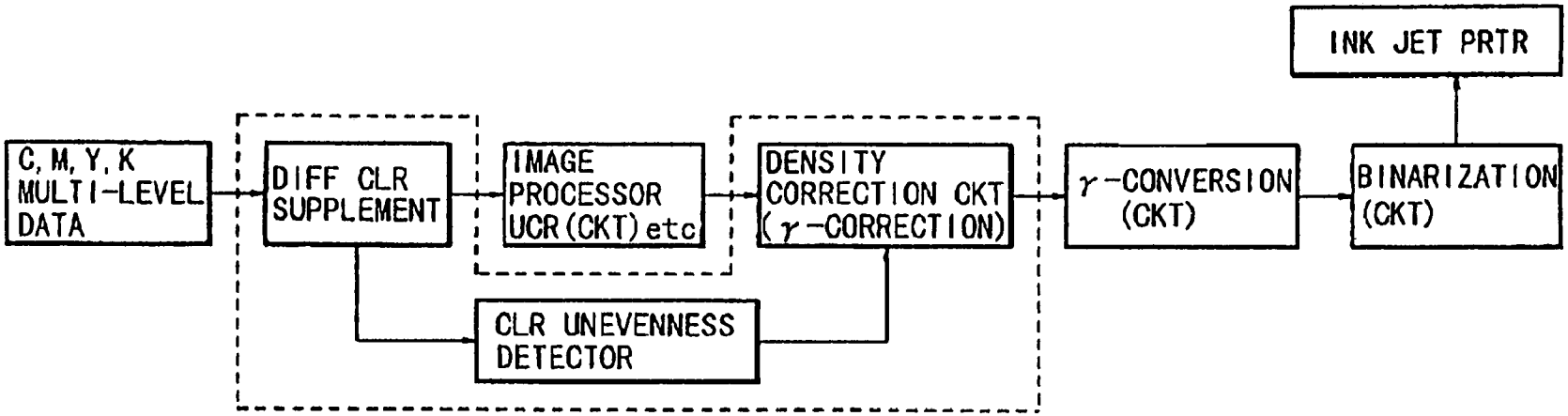
FIG. 3 is a block diagram of a compensating means.
Figure 3B:
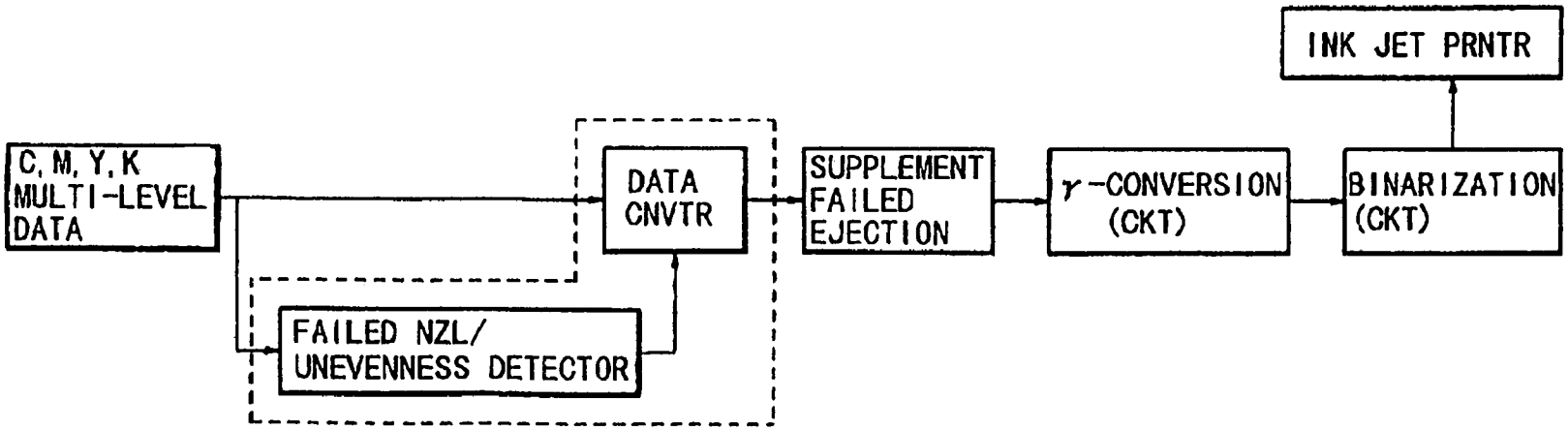

The preferred embodiments of the present invention will be described.

In the descriptions given below, a nozzle which has failed to eject ink, a nozzle which has deviated in terms of the direction in which an ink droplet is ejected therefrom, and a nozzle which has deviated in terms of the amount by which ink is ejected, are referred to as a nozzle which cannot be used for recording. In the present invention, these nozzles are treated as nozzles, or recording elements, which do not record. The gist of the present invention is to compensate for these nozzles which have failed to properly eject ink, so that the portion of an image correspondent to the failed nozzle will be less conspicuous. Below, concrete embodiments of the present invention will be described in detail. Incidentally, a nozzle which has begun to fail to normally record may sometimes be referred to as a bad nozzle or a bad recording element in the following description of the embodiments of the present invention.

First, a method for recording while compensating for various bad nozzles correspondent to the missing portions of an image printed prior to the compensation, so that the portions of an image to be printed thereafter correspondent to the bad nozzles will not appear as conspicuous while lines, will be described.

<Brightness Compensation>

In this method, an image is recorded while compensating for a designated nozzle which has begun to suffer from ejection failure or the like, with the use of another nozzle, or a compensatory nozzle, different in ink color from the designated nozzle, so that the dots which the designated nozzle would records if it were not for the ejection failure will be recorded by the another nozzle different in ink color. More specifically, the output data (hereinafter, "image data") for a compensatory nozzle are created based on the original image data for a designated nozzle which has begun to suffer from ejection failure, so that the brightness of the image realized by the compensatory nozzle matches the brightness of the image which would have been realized by the designated nozzle based on the original image data if it were not for the ejection failure. More precisely, the output data for the compensatory nozzle are created so that the brightness of the portion of an image, which will be recorded by the compensatory nozzle will match the brightness of the portion of the image, which could have been formed by the designated nozzle based on the original output data if it were not for the ejection failure. More precisely, the brightness is match in such a manner that the brightness of a solid monochromatic image which will be recorded by the compensatory nozzle will match the brightness of a solid monochromatic image which would have been formed by the designated nozzle based on the original output data if it were not for the ejection failure. When the compensatory nozzle is matched with the failing designated nozzle in the brightness of the images they record, as described above, the dots which the designated nozzle will fail to record will be redeemed by the compensatory nozzle so that the missed dots become inconspicuous.

Obviously it is desired that the color of the missing dot is redeemed by color which is as close in chromaticity as possible to the original color of the missed dot. For example, it has been known that an ordinary color ink jet printer uses four color inks: cyan (C) ink, magenta (M) ink, yellow (Y) ink, and black (Bk) ink. When it is necessary to compensate for the ejection failure of a nozzle for cyan ink of a color ink jet printer which uses a plurality of inks different in color as described above, the compensation can be made with the use of a recording head nozzle which ejects magenta ink, which is virtually identical in brightness to cyan ink, or a recording head nozzle which ejects black ink which is relatively close in brightness to cyan ink. More concretely, the output data for a black ink nozzle or magenta ink nozzle are converted into such output data that realize the same brightness as the brightness which the output data for the failed cyan ink nozzle would have realized, and an image is outputted based on the output data obtained by the combination of the converted data and original data for the black ink nozzle or magenta ink nozzle.

Therefore, even if ejection failure occurs, it is possible to compensate for the ejection failure by carrying out a process which will be described next, with reference to FIG. 2.

FIG. 2 is a flow chart for the aforementioned method for brightness compensation. In step S1, a head or a nozzle which has failed to eject ink is identified. This identification is made by reading the data which had been written in an E2PROM regarding the nozzles which were identified to be nonfunctional during head production, is made based on images outputted by the recording apparatus, or is made with the use of a sensor capable of detecting a nonfunctional nozzle. As for the setup for detecting a nonfunctional nozzle, various setups may be adopted, for example, a setup for optically detecting the state of ink ejection, a setup for detecting a nonfunctional nozzle by reading a test image recorded by an image forming apparatus, and the like. Next, in step S2, the color output data (multiple value data) of a nonfunctional nozzle is read, and the intended brightness is obtained from the read data. Next, in step S3, the data for the color of the ink to be ejected by a compensatory nozzle are created according to the brightness value obtained from the output data for the nonfunctional nozzle. As described above, these compensation data are created so that the compensatory nozzle matches the nonfunctional nozzle in the brightness of the images they record. In an actual operation, a table which shows the values of the output data for each color and the correspondent brightness values, is used to convert the output data for the compensatory nozzle into data, which match the data for the failed nozzle. In FIG. 2, a table designated by a referential code 21 is the table used for a process in which black ink is used for compensating for the misting dot. This process will be described later.

The inventors of the present invention made the following discovery. That is, if a portion of an image, which has a width of d fails to be recorded, this portion is recognized as a white line. Provided that the value of d is sufficiently small, if compensation is made for the nozzles which failed to record this strip of image portion, or the missing portion b of an image, with the use of another nozzle different in ink color from the failed nozzle, the portion of an image printed thereafter correspondent to the missing portion b will be filled with ink which is different in color from the ink which will color the adjacencies of the portion of the image correspondent to the missing portion b, the brightness of the portion of an image printed thereafter, correspondent to the missing portion b, will be matched so closely to the original brightness, or the brightness of the areas surrounding the portion correspondent to the missing portion b, that it will be impossible to differentiate this portion of the image from the surrounding areas despite the fact that the former is different in color from the latter.

More concretely, FIG. 1A shows an image, the color of which is a, and a long and narrow portion b of which has failed to be recorded. The width of this strip is d. FIG. 1B shows an image which is the same as that in FIG. 1 and is recorded by the same recording head, except that while the image in FIG. 2 was recorded, compensation is made for the nozzles which had effected the portion b, with the use of other nozzles of the same recording head, which ejected ink different in color from the failed nozzles, so that the brightness of the portion of the image, correspondent to, the missing portion, or the portion b, became as close as possible to the brightness of the surrounding areas. FIG. 1C is a graph which shows the results of experiments in which the relationship between the width d and the distance from which the portion of an image correspondent to the portion b is perceivable, was studied. In these experiments, the areas a were recorded in cyan or magenta, and whether or not the strip b could be detected as an anomaly was tested while changing the width d and the distance between the image and the eyes of an observer. In one half of the experiments, no compensation was made for the nozzles which had failed to record the strip b: in other words, the strip b was left as a blank (white) strip, whereas in the other halt of the experiments, the compensation was made for the failed nozzles, with the use of the nozzles which ejected black ink. In FIG. 1C, the axis of abscissas represents the width d, and the axis of ordinates represents the longest distance from which the anomaly could be detected. Also in FIG. 1C, white dots represent the experiment in which no compensation was made, and black dots represent the experiment in which the aforementioned compensation was made. As is evident from FIG. 1C, when the width d of the strip b portion was approximately 20 μm, the portion b could not be recognized as long as the distance between the image and the eyes of the observer was not less than 80 cm, whereas when the width d of the portion b was approximately 10 μm, the portion b could not be detected as long as the aforementioned distance was no less than 40 cm. In other words, FIG. 1C shows that when the distance between an image and the eyes of an observer is no less than 40 cm, the portion b of the image with a width of approximately 10 μm is difficult to detect, and that when the distance between an image and the eyes of an observer is no less than 80 cm, the portion b of the image with a width of approximately 20 μm is difficult to recognize.

On the other hand, in the case in which images were recorded while compensating for the nozzles which failed to record the portion b, with the use of nozzles which record in black color, the relationship between the width d of the portion b and the distance between the image and the eyes of the observer became as represented by black dots in FIG. 1C. It is evident from the black dots in FIG. 1C that when the width d of the portion b was approximately 90 μm, the portion b was difficult to detect as long as the distance between the image and the eyes of the observer was no less than 40 cm, and also that when the width d of portion b was approximately 50 μm, the portion b was difficult to detect as long as the viewing distance was not less than 20 cm. In other words, the studies proved that the portion b was much harder to detect when the aforementioned compensation in brightness was made with the use of the nozzles different in color from the failed nozzles than when no compensation was made.

As is evident from the results of the aforementioned studies, if a recording operation is carried out in a manner to compensate for the failed nozzles with the use of other nozzles different in ink color from the failed nozzles so that the brightness of the portion of an image printed thereafter, correspondent to the missing portion b of the preceding image, which will be recorded by the compensatory nozzles, will match the brightness of the areas adjacent to the portion of the image correspondent to the missing portion b of the preceding image, the detectability of the portion of the image correspondent to the portion b will drop to approximately 1/10 compared to when the compensation is not made.

Also, even if the size of the portion b was increased, the detectability of the portion b relative to the portion a remained approximately the same.

Thus, it is evident that if the portion b is narrower enough relative to the observation distance, and compensation is made for the failed nozzles with other nozzles different in ink color from the failed nozzles so that the brightness of the portion b matches the brightness of the portion b which the failed nozzles will have provided, the portion b is difficult to detect as an abnormal line.

In the studies described above, the compensation was made with the use of nozzles which eject black ink. The same can be said even if nozzles which eject ink other than black ink are used as the compensatory nozzles. In particular, in the above described studies, when the viewing distance was 25 cm, the portion b could be detected if the width d was no less than 60 μm (d is approx. 60 μm). Thus, it is evident that if only a single nozzle of a printer which prints in 400 dpi is not ejecting (no consecutive two nozzles are not ejecting), the anomaly, or the unwanted line, cannot be detected. Even if the number of the failed nozzles is two or more, the compensation will provide a reasonably good result.

<Black Ink Based Brightness Match>

This compensation method is characterized in that compensation is made for failed nozzles with the use of other nozzles or live nozzles which place black dots on recording medium, and that the brightness of an area uniformly covered with the dots ejected based on the output data is very close to the brightness of an area uniformly covered with the dots which would have been ejected by the failed nozzle based on the output data for the failed nozzles. Obviously, the color of the ink used for the compensation is desired to be as close in chromaticity as possible to the color of the ink for the failed nozzles. For example, when it is necessary to make brightness compensation for a failed nozzle for ejecting cyan ink, it is desired that brightness is matched with the use of magenta or black ink. However, from the viewpoint of chromaticity, the border between an area with cyan color and an area with magenta color is relatively conspicuous due to the difference in chromaticity between cyan and magenta colors. Therefore, brightness compensation with the use of black ink is more desirable than brightness compensation with the use of magenta ink. More concretely, the output data for the nozzle for cyan ink are converted into output data for a nozzle for black ink, and black ink is ejected based on a combination of the thus obtained output data for a nozzle for black ink and the original data for black ink.

For example, the output data for cyan ink is converted into output data for black ink in the following manner.

Figure 5:
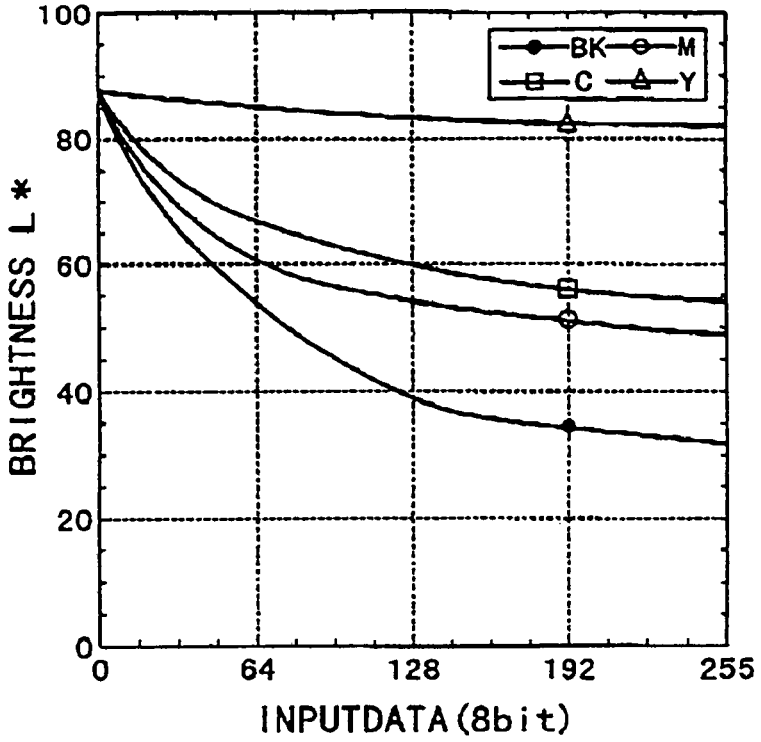
FIG. 5 is a graph showing the brightness of each color relative to input value.

FIG. 5 is a graph which shows the gradation in brightness when recording is made on ordinary paper with the use of inks different in color. The axis of abscissas represents input value, and the axis of ordinates represents brightness. For example, when the data for cyan color was "192", the corresponding brightness L was approximately "56". On the other hand, an input value for black color at which the corresponding brightness became approximately "56" was approximately "56." Based on this discovery, after the detection of the failure of the nozzle for cyan ink, the data "192" for a nozzle for cyan ink is converted into the data "56" for the nozzle for black color.

Figure 6:
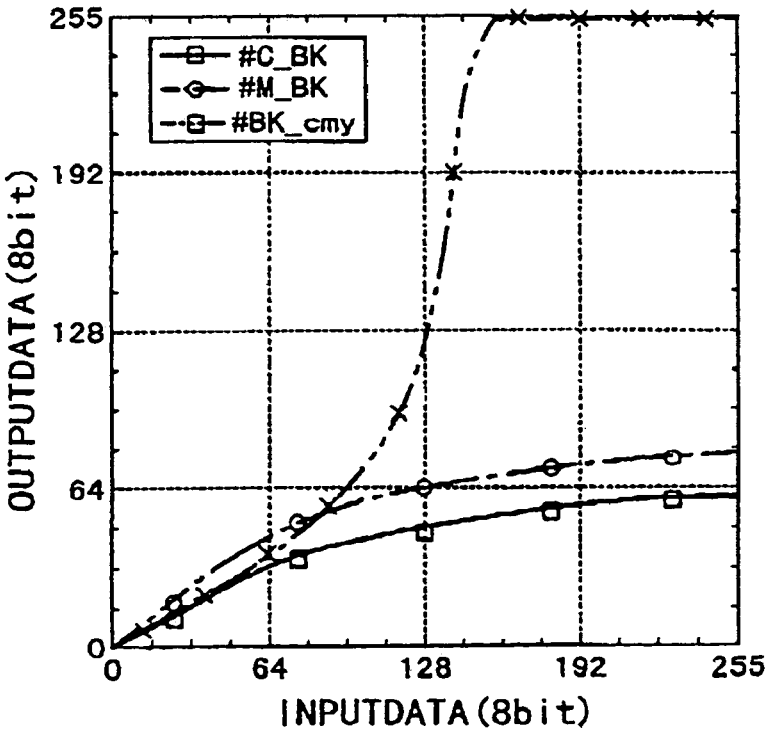
FIG. 6 is a graph showing the tables used for compensating for a bad nozzle with the use of a nozzle different in ink color from the bad nozzle.

FIG. 6 shows the relationship between the data for a nozzle for cyan ink and a nozzle for magenta ink, and the data for a nozzle for black ink obtained by the conversion for the compensation of a failed nozzle for cyan ink, or a failed nozzle for magenta ink. In other words, FIG. 6 shows the relationship between the input data and output data in the data conversion made for the compensation for a failed nozzle. In the graph, a line #C-Bk stands for the case in which compensation was made for a failed nozzle for cyan color with the use of a nozzle for black ink, and a line #M-Bk stands for the case in which compensation was made for a failed nozzle for magenta ink with the use of a nozzle for black ink.

When compensating for a failed nozzle for cyan ink or a nozzle for magenta ink with the use of a nozzle for black ink, the effect of a failed nozzle for cyan ink or a failed nozzle for magenta ink can be reduced by converting the data for the nozzle for cyan ink or nozzle for magenta ink into data for the nozzle for black ink, according to a table for making a conversion such as the conversion represented by FIG. 6, and controlling the nozzle for black Ink based on a combination of the thus obtained data and original data for the nozzle for black ink. The brightness of a solid yellow color portion of an image is not much different from that of the surface of ordinary paper. In other words, because a spot or a strip in the yellow portion of an image, which failed to be recorded, is difficult to detect with the human eye, it is unnecessary to compensate for a failed nozzle for yellow ink with the use of a nozzle different in ink color. Incidentally, a line #Bk-cmy in FIG. 6 represents the case in which compensation is made for a failed nozzle for black ink with the use of a nozzle for cyan ink, a nozzle for magenta ink, and a nozzle for yellow ink. As is evident from the line #Bk-cmy, it is possible to compensate for a failed black ink nozzle with the use of a combination of the cyan, magenta, and yellow ink nozzles. Obviously, the relationships shown in FIGS. 5 and 6 change depending on the types of recording medium and ink, amount by which ink is ejected, and the like factors. Therefore, various conversion tables must be prepared so that a proper table can be selected depending on a system to be used.

<Compensation by Black Ink Nozzle>

In the compensation method described above, the compensation for a failed nozzle for one of inks different in color was made with the use of a nozzle different in ink color from the failed nozzle, in such a manner that, as the portion of an image correspondent to the failed nozzle is recorded by the compensatory nozzle, or the nozzle different in ink color, so that the brightness of this portion realized by the compensatory nozzle matches the brightness which would have been realized if the failed nozzle had not failed. The compensation method which will be described next is such a method that the data for the failed nozzle are converted into data for a nozzle for black ink with no regard to brightness. This method is characterized in that compensation is made for a failed nozzle by replacing the dots which would have been placed if it were not for the ejection failure, with the dots ejected by a nozzle different in ink color from the failed nozzle, and that the compensation is made with the use of a nozzle for black ink.

In this method, the data for the failed nozzle are used as OR data for a nozzle for black ink.

It is preferable that data obtained based on the multiple value data for the failed nozzle through such calculations as multiplying by a constant factor are used as the OR data for the nozzle for black ink, or that the compensation is made based on the data for the nozzle for black ink obtained based on the multiple value data for the failed nozzle, through quantization such as binarization or the like.

Further, the portion of an image correspondent to the failed nozzle may be recorded with the use of the nozzle for black ink, after the quantization such as binarization. In this case, the dots density may be reduced by masking the data used for recording.

According to this method, compensation can be made by simple calculation, without the need for preparing one table for each color. Therefore, this method can make inconspicuous the portion of an image correspondent to a failed nozzle, without complicating apparatus structure.

<Compensation by Head Shading>

Next, a method for making inconspicuous the portion of an image correspondent to a failed nozzle by head shading will be described. Head shading is a technique used for preventing a recording head having a plurality of nozzles from producing an image nonuniform in density when the plurality of nozzles are different in ejection properties. According to this technique, when recording with the use of a recording head having a plurality of nozzles, each nozzle is provided with data for density equalization, in order to form an image, the nonuniformity in density of which is inconspicuous. More concretely, the density of a test image recorded with the recording head is read by a scanner, and the nozzles correspondent to the portions of the image low in density is provided with supplemental data for increasing the density of the low density portion of the image. On the contrary, the nozzles correspondent to the portion of the image high in density is provided with data (supplemental data) for reducing the density at which the nozzle correspondent to the high density portion of the image records. As a result, an image less nonuniform in density is formed.

In the head shading technique in this embodiment, if a spot or strip of unrecorded area is detected in a test image, the printing duty of the nozzles for recording the areas contiguous to the unrecorded area is increased so that when an image is formed in a normal operation, the portion of the image correspondent to the unrecorded area in the test image will becomes inconspicuous.

As will be separately and more concretely described later, in head shading, the density of a test pattern recorded by a recording head having a plurality of nozzle is read, and the output γ of each nozzle is modified according to the nonuniformity in the read density, in order to prevent the occurrence of nonuniformity in density in a normal printing operation. When an image is formed at a resolution within a range of 400 dpi–600 dpi, the output of a given nozzle is modified so that the density value of the area to be recorded by the given nozzle will become the average value between the density value of the area in the test pattern recorded by the given nozzle and the density values of the areas recorded by the nozzles sandwiching the given nozzle.

Therefore, if there is a failed nozzle, the density value for the areas to be recorded by the nozzles sandwiching the failed nozzle is reduced. Thus, according to head shading, if there is a failed nozzle, the print data for the nozzles sandwiching the failed nozzle are adjusted in the direction to increase the density.

As a result, in the adjacencies of the portion of the image correspondent to the failed nozzle, the printing dot count of the portions (inclusive of both sides of the portion correspondent to the failed nozzle) contiguous to the portion correspondent to the failed nozzle becomes virtually the same as the dot count for the same area without the failed nozzle, making inconspicuous the nonuniformity in density in this portion of the image.

Figure 4A:
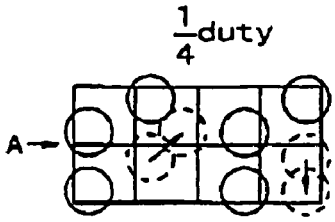
FIG. 4 is a rough drawing for describing a compensating method called head shading.

FIGS. 4A. 4B, 4C, 4D, and 4E schematically show the manner in which the image data for the nozzles sandwiching a failed nozzle are modified by head shading. FIGS. 4A, 4B, 4C, and 4D each represent a case in which when recording is made at a duty of 100%, four dots are placed per cell of the grid. FIG. 4E represents a case in which when recording is made at a duty of 100%, two dots are placed per square. In these drawings, the vertical direction coincides with the direction in which the nozzles of a recording head is aligned, and areas designated by a referential code A are the unrecorded portions of an image, or the portions of an image correspondent to a failed nozzle.

FIG. 4A shows the manner in which an image is recorded at ¼ duty. In this case, the data for the nozzles sandwiching the failed nozzle are modified in the direction to increase the density, which results in increases in dot count. FIG. 4E shows the manner in which an image is recorded at ⅛ duty. When printing duty is as low as in the case represented by FIG. 4E, an unrecorded spot or strip resulting from the presence of a failed nozzle is inconspicuous as it is, and therefore, as the number of dots placed by the nozzles sandwiching the failed nozzle increases due to the compensation for the failed nozzle, the apparent density of this portion recorded by a defective recording head, or a recording head with a failed nozzle, based on the modified data is not much different from the apparent density of this portion recorded by a normal recording head.

Figure 4B:
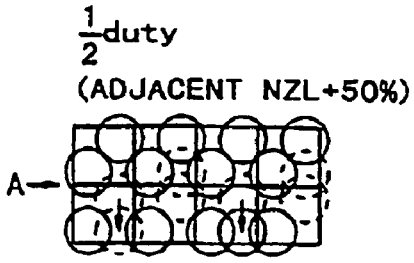
Figure 4C:
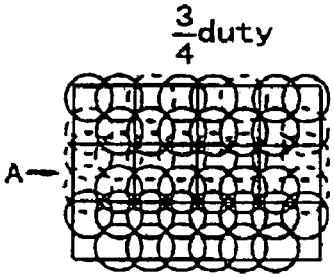
Figure 4D:
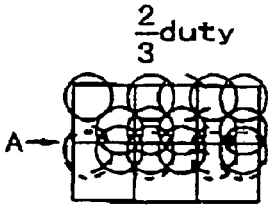
Figure 4E:
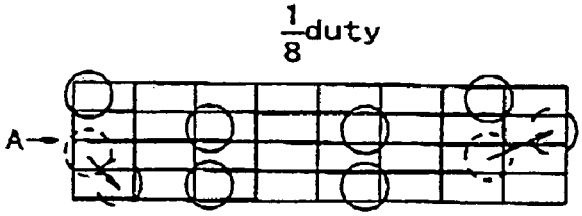

FIG. 4B shows the manner in which an image is recorded at ½ duty (50%). and FIG. 4C shows the manner in which an image is recorded at ¾ duty (75%). In the case represented by FIG. 4C, duty is rather high, and therefore, if only the nozzles sandwiching a failed nozzle are involved for compensating for the failed nozzle, it is impossible to realize the image density which would have been realized if the failed nozzle had not failed. Therefore, not only the data for the nozzles immediately adjacent to the failed nozzle are modified in the direction to increase the image density, but also the data for the second nozzles from the failed nozzle are modified in the direction to increase image density. As is evident from FIGS. 4B and 4C, the higher the density at which dots are placed, the more conspicuous the portion of an image correspondent to a failed nozzle (portion indicated by arrow mark A), that is, the more likely is it to be detected as an unwanted line.

As is evident from the above description of head shading, head shading is very useful when an image is recorded at a relatively low duty, because it can prevent the density of the portion of an image correspondent to a failed nozzle, from reducing.

Figure 4F:
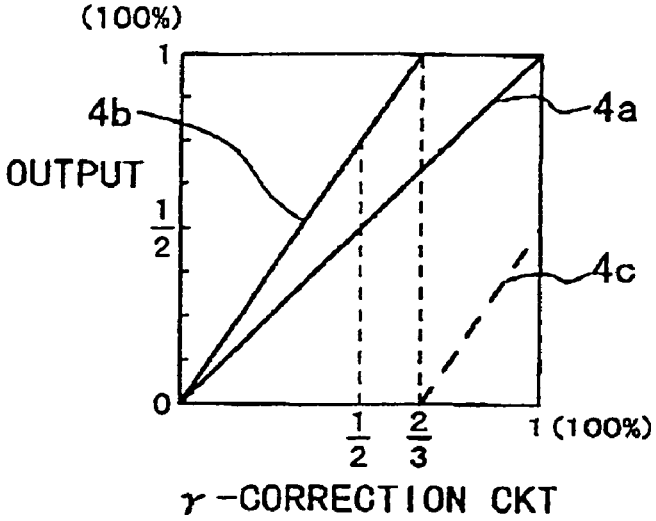

FIG. 4F represents the case in which the γ-correction of the nozzles immediately adjacent to a nozzle deemed failed are adjusted by the above described head shading or the like technique. In FIG. 4F, a line 4*a* represents a case in which output was not adjusted, and a line 4*b* represents a case in which the original image data was modified so that the γ-correction is adjusted in the direction to increase the density to 1.5 times the original density. As is evident from these drawings, the image data may be modified so that the output of the nozzles immediately adjacent to the failed nozzle is adjusted in the direction to increase the density to a maximum of 1.5 times the original density by adjusting the γ-correction.

Also in FIG. 4F, a line 4*c* represent a case in which recording was made while compensating for a failed nozzle with the use of nozzles different in ink color from the failed nozzle. This case will be described later.

As described above, head shading technique makes the dot count for the portion of an image contiguous with the portion of the image correspondent to a failed nozzle approximately the same as the dot count for the portion of the image, which surrounds the portion of the image contiguous to the portion of the image correspondent to the failed nozzle, and therefore, the portion of the image correspondent to the failed nozzle is less likely to be detected as an unwanted line.

<Combination of Brightness Based Compensation and Head Shading Based Compensation>

It is possible to use in combination the above described compensation method in which the portion of an image correspondent to a failed nozzle is recorded with the use of a nozzle different in ink color from the failed nozzle, and compensation method in which the portion of an image correspondent to a failed nozzle is recorded with the use of the nozzles adjacent to the failed nozzle.

Next, a method in which the above described compensation method in which the portion of an image correspondent to a failed nozzle is recorded with the use of a nozzle different in ink color from the failed nozzle, and compensation method in which the portion of an image correspondent to a failed nozzle is recorded with the use of the nozzles adjacent to the failed nozzle are used in combination to make more inconspicuous the portion of the image correspondent to the failed nozzle, will be described.

When using this method, it is desired that a recording head is adjusted as necessary to optimize the performance of the recording head in the various aspects of the recording head. In this combination method, while recording is made at a relatively low duty, head shading makes the dot count of the surrounding area, that is, the combination of the immediate adjacencies of the portion of an image correspondent to a failed nozzle and the two portions sandwiching the immediate adjacencies, approximately the same as the number of dots which would have been placed if the failed nozzle had not failed, and therefore, the nonuniformity in density is not detected, as described above (FIGS. 4A–4E).

However, if the head shading technique is used when recording at a relatively high duty, for example, when recording an image of solid color, the portion of the solid color image correspondent to a failed nozzle remains conspicuous, appearing as a white line. Thus, only when recording at a relatively low duty, head shading is used for compensation, and when recording at a relatively high duty, compensation is made with the use of the brightness based compensation method, that is, the method in which a nozzles different in ink color from the failed nozzle is used for compensation. In other words, regardless of printing duty, the combination method can prevent a failed nozzles from leaving harmful effects on an image.

FIG. 4F represents cases in which the head shading based compensation method, and brightness based compensation method using a nozzle different in ink color, are used in combination. More specifically, when printing duty is relatively high, for example, when printing duty is no less than ¾ (76%)3 the compensation for a failed nozzle is made by filling the portion of an image correspondent to a failed nozzle with color different from the original color, with the use of a nozzle different in ink color from the failed nozzle, in such a manner that the brightness of the portion of the image correspondent to the failed nozzle matches the brightness of its adjacencies different in color as shown by the dotted line 4*c* in the drawing, whereas when printing duty is relatively low, for example, no more than ¾ (70%), the portion of an image correspondent to a failed nozzle is made inconspicuous by increasing the density of the portions of the image correspondent to the nozzles immediately adjacent to the failed nozzle, by increasing by adjusting the γ-correction the outputs of the nozzles sandwiching the failed nozzle 1.5 time the original outputs as indicated by the straight line 4*b* in the graph. In FIG. 4F, a straight line 4*b* represents a case in which the outputs of the nozzle sandwiching the failed nozzle are increased to 1.6 times the normal output to compensate for the failed nozzle by adjusting the γ-correction.

Next, the aforementioned compensation methods will be described in detail with reference to an ink jet recording apparatus.

The present invention is applicable to a printer having a scanning function. The present invention is also applicable to any printer into which data regarding density anomaly and failed nozzle data obtained through the reading of a test pattern for detecting failed nozzles and nonuniform density can be inputted. However, in this embodiment, the compensation methods will be described with reference to an ink jet color copying machine capable to reading and recording a color image.

(Embodiment 1)

<Brightness Compensation Method Based on Black Ink>

In this embodiment, the compensation for a failed nozzle for cyan ink and a failed nozzle for magenta ink is made With the use of a nozzle for black ink, based on the image data for the failed nozzle, in such a manner that the brightness of the portion of an image correspondent to the failed nozzle matches with the brightness of the surrounding portions of an image.

Hereinafter, the preferable embodiment of the present invention will be described in detail with reference to the appended drawings.

Figure 13:
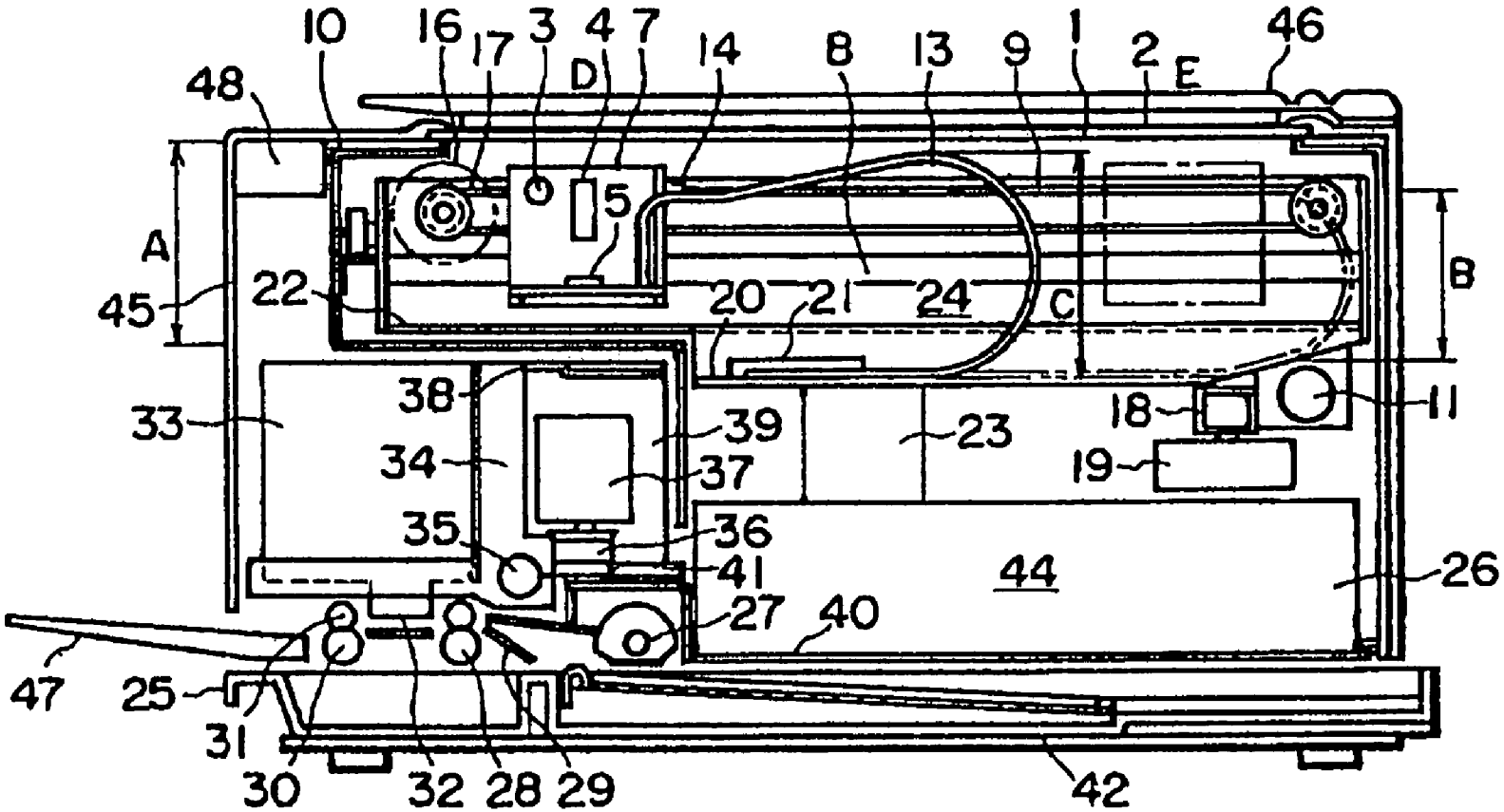
FIG. 13 is a sectional view of a color copying machine, as an example of an ink jet recording apparatus, in an embodiment of the present invention, and shows the structure thereof.

FIG. 13 is a sectional view of a color copying machine inclusive of an ink jet recording apparatus, in this embodiment, and shows the structure thereof.

This color copying machine comprises an image reading/processing portion (hereinafter, "reader portion 24"), and a printer portion 44. The reader portion 24 comprises: a CCD line sensor 5 equipped with three filters: R, G, and B color filters, a glass platen 1 for an original. An original 2 placed on the glass platen 1 is scanned and read by the CCD sensor 5, and the obtained data regarding the original 2 are processed by an image processing circuit. The process data are sent to the printer portion 44 having four ink jet heads: ink jet head for cyan ink, ink jet head for magenta ink, ink jet head for yellow ink, and ink jet head for black ink. The printer 5 records an image on recording medium such as paper (hereinafter, "recording paper") with the use of four ink jet heads, based on the image data sent to the printer portion 44.

Incidentally, the printer portion 44 is capable of recording an image based on external data, which are inputted into the copying machine and are processed by the image processing circuit.

Next, the operation of the apparatus will be described in detail.

The reader portion 24 comprises portions 1–23, and the printer portion 44 comprises portions 25–43. In FIG. 13, the top left side of the drawing coincides with the front side of the apparatus, which an operator faces.

The printer portion 44 has an ink jet head 32 (which hereinafter may be referred to as recording head), which records an image by ejecting ink. The recording head 32 has, for example, 128 nozzles for ejecting ink, which are arranged in a predetermined pattern. The outward side of each nozzle has an ejection orifice. In this embodiment, 128 nozzles are aligned in a predetermined direction at a pitch of 63.5 microns, being enabled to record 8.128 mm wide per scanning run. Thus, when recording on recording paper, conveyance of the recording paper (in the secondary scanning direction) is temporarily stopped, and in this state, the recording head 32 is moved in the direction perpendicular to the plane of FIG. 13, recording 8.128 mm wide, by a necessary distance. Then, the recording paper is conveyed by exactly 8.128 mm and is stopped, and in this state, the next 8.128 mm wide portion of the image is recorded. This combination of moving the recording paper and recording 8.123 mm wide is repeated. This recording direction is referred to as the primary scanning direction, and the direction in which recording paper is conveyed is referred to as the secondary scanning direction. With reference to FIG. 13, the primary scanning direction is the direction perpendicular to the plane of FIG. 13, and the secondary scanning direction is the left to right direction in FIG. 13.

The reader portion 24 reads the original 2 by repeatedly scanning 8.128 wide in the manner similar to the printer portion 44. The reading direction is referred to as the primary scanning direction, and the direction in which the reader portion 24 moves to read the next strip of the original 2 is referred to as the secondary scanning direction. The primary scanning direction is the direction left and right direction in FIG. 13, and the secondary scanning direction is the direction perpendicular to the plane of FIG. 13.

The operation of the reader portion 44 is as follows.

The original 2 on the glass platen 1 is illuminated by a lamp 3 on a carriage 7 for primary scan, and the image of the original 2 is led to a photosensitive element 5 (CCD line sensor) through a lens array 4. The primary scan carriage 7 is engaged with a main scan rail 8 on a secondary scan unit 9, being enabled to slide along the primary scan rail 8. Further, the primary scan carriage 7 is connected to a primary scan belt 17 with the use of an unshown connecting member. The primary scan carriage 7 is moved in the left or right direction by the rotation of a primary scan motor 16 while reading the original 2.

The secondary scan unit 9 is engaged with a secondary scan rail 11 solidly fixed to an optical unit frame 10, being enabled to slide along the secondary scan rail 11. Further, the secondary scan unit 9 is connected to a secondary scan belt 18 with the use of an unshown connecting member. Therefore, the secondary scan unit 9 is moved in the direction perpendicular to the plane of FIG. 13 to read the next strip of the original.

The image of the original 2 sent to the CCD 5 is read by the CCD 5, and the CCD outputs image signals in accordance with the original 2. These image signals are transmitted to the secondary scan unit 9 through a flexible signal cable 13 bent in the looping manner. One end of the signal cable 23 is gripped by a gripping portion 14 of the primary scan carriage 7, and the other end is fixed to the bottom surface 20 of the secondary scan unit 9 with the use of a member 21, being connected to a secondary scan signal cable 23 which connects the secondary scan unit 9 and the electrical unit 26 of the printing portion 44. The signal cable 13 follows the movement of the primary scan carriage 7, and the secondary scan signal cable 23 follows the movement of the secondary scan unit 9.

Figure 14:
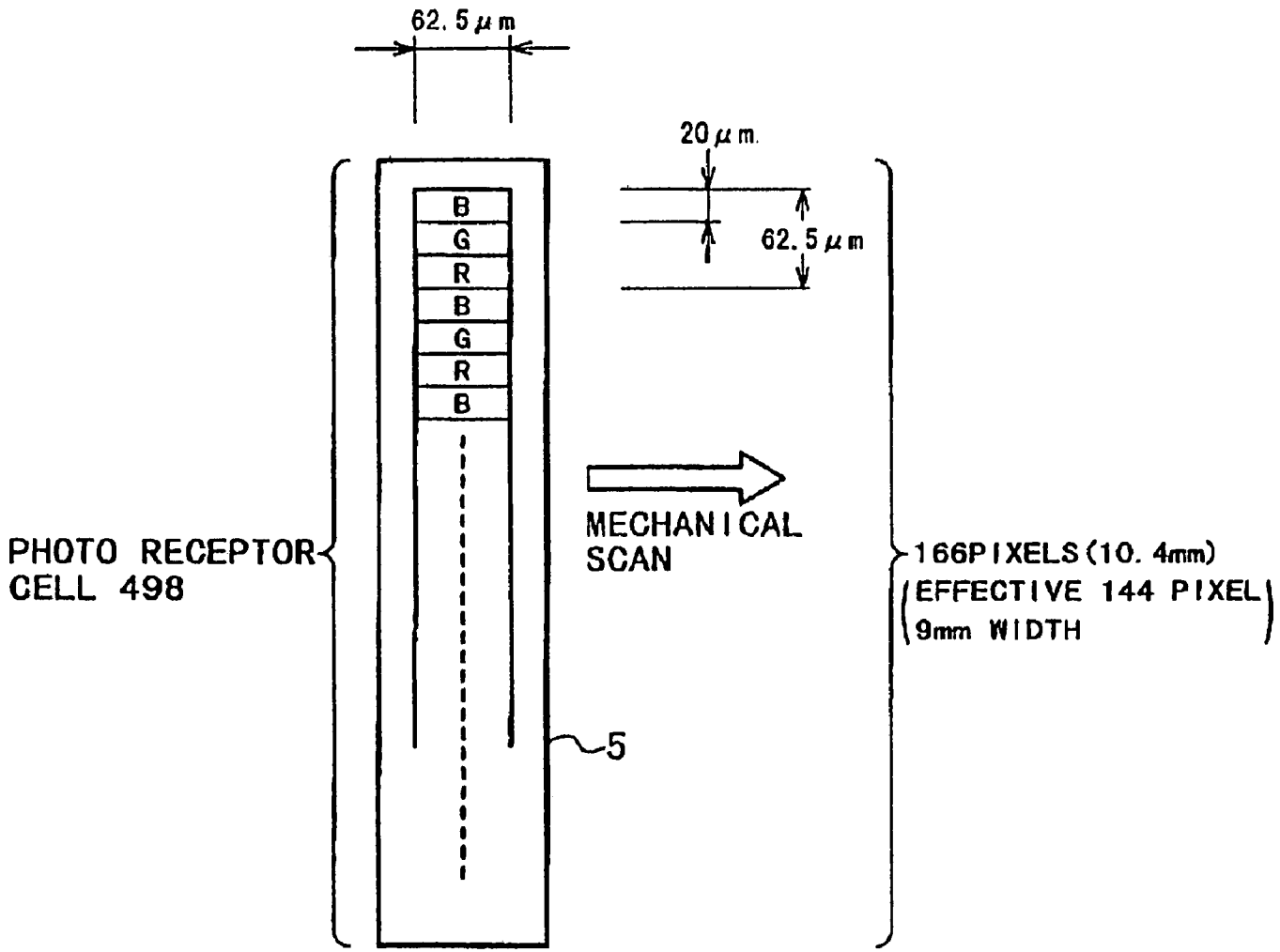
FIG. 14 is a detailed drawing of a CCD line sensor (photosensitive element).

FIG. 14 is a drawing for showing the detail of the CCD ling sensor 5 in this embodiment. This ling sensor 5 comprises 498 photocells arranged in a straight line. Since a combination of three photocells, or photocells for R, G, and B primary colors, corresponds to a single picture element, this line sensor 5 can theoretically read 166 picture elements. However, the number of effective picture elements is 144. A combination of the 144 picture elements is approximately 9 mm wide.

Next, the operation of the printing portion 44 will be described.

The recording paper is sent, one by one, out of a recording paper cassette 25 by a sheet feeding roller 27 driven by an unshown power source. Then, recording is made on the recording paper by the recording head 32 while the recording paper is conveyed between a pair of rollers 28 and 29, and another pair of rollers 30 and 31. The recording head 32 is integral with an ink container 33, and is removably mounted on the primary scan carriage 34 of the printer. The printer's primary scan carriage 34 is slidably engaged with the primary scan rail 35 of the printer The primary scan carriage 34 of the printer is connected toe the primary scan belt 36 with the use of an unshown connecting member. Therefore, as the primary scan motor 37 rotates, the primary scan carriage 34 of the printer moves in the direction perpendicular to the plane of FIG. 13, performing the primary scan operation.

The primary scan carriage 34 of the printer is provided with an arm 38 to which one end of a printer signal cable 39 for transmitting signals to the recording head 32 is fixed. The other end of the printer signal cable 39 is fixed to a center plate 40 of the printer, and is connected to the electrical unit 26. The printer signal cable 39 follows the movement of the primary scan carriage 34 of the printer, and is configured so that it does not come into contact with the optical unit frame 10 located above the primary scan carriage 34 of the printer.

As for the secondary scan of the printing portion 44, the recording paper is conveyed 8.128 mm each time the pair of rollers 28 and 29 and the pair of rollers 30 and 31 are rotated by an unshown power source. A referential code 42 designates the bottom plate of the printer portion 44; 45, an exterior plate; 46, a pressing plate for pressing the original 2 against the glass platen 1; 1009, a discharge opening (FIG. 26); 47, a delivery tray; and a referential code 48 designates the electrical unit.

Figure 15:
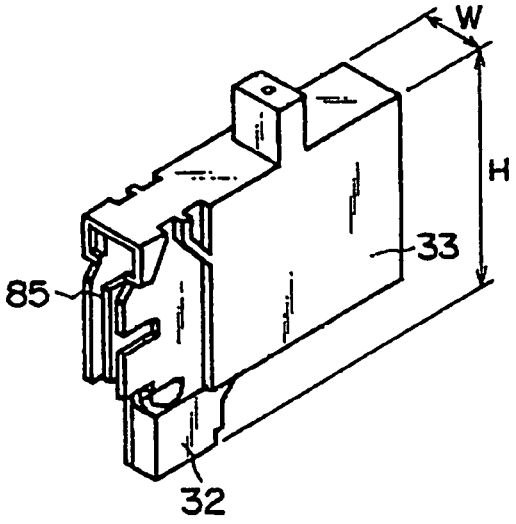
FIG. 15 is an external perspective view of an ink jet cartridge.
Figure 16:
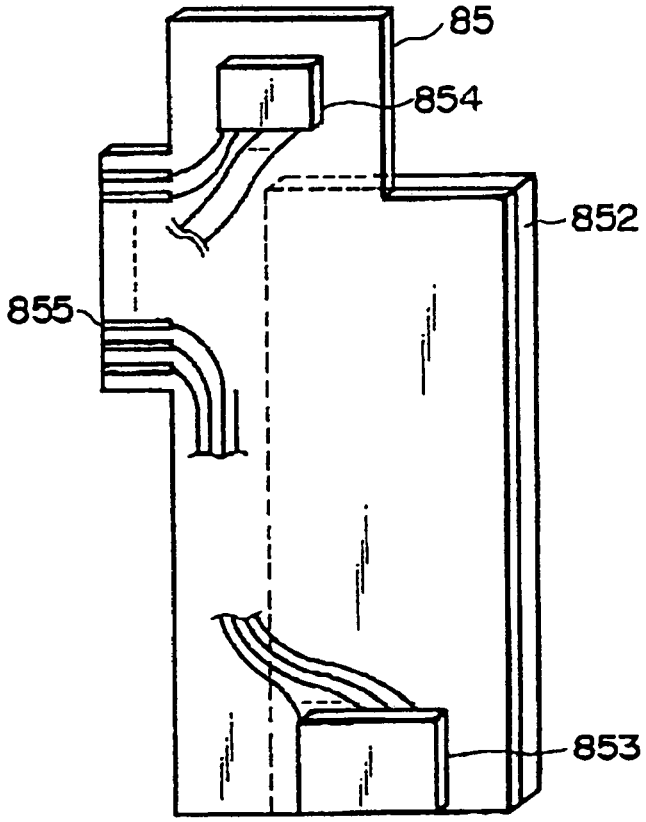
FIG. 16 is a detailed perspective view of the pi-inter ink jet substrate 85.

FIG. 15 is an external perspective view of the ink jet cartridge of the printer portion 44 of the color copying machine in this embodiment. FIG. 16 is a perspective view of the ink jet substrate 85 illustrated in FIG. 15, and shows the details of the ink jet substrate 85.

In FIG. 16, designated by the referential code 85 Is the ink jet substrate; 852, a heat radiating aluminum plate; 853, a heat board comprising a heat generating element and a diode matrix; and designated by a referential code 854 is a storage medium in which the data regarding each of 854 nozzles are stored in advance. The storage medium 854 is a nonvolatile memory such as an EEPROM, or may be any other medium as long as it is compatible with the present invention.

In this embodiment, data regarding whether or not each nozzle has failed or not failed are stored in the storage medium 854. However, data regarding nonuniform density or the like may be also stored in the storage medium 854.

Designated by a referential code 855 is an electrical contact at which the ink jet substrate 85 is electrically connected to the main assembly of the printer portion 44. In FIG. 16, a plurality of ejection orifices arranged in a straight line are not shown.

With the provision of the above described structural arrangement, as the recording head 32 is mounted into the apparatus main assembly, the apparatus main assembly reads the data regarding the failed nozzles, from the recording head 32, and carries out a predetermined control for reducing nonuniformity in density, based on the read data, in order to assure that an image with good quality will be produced.

Figure 17A:
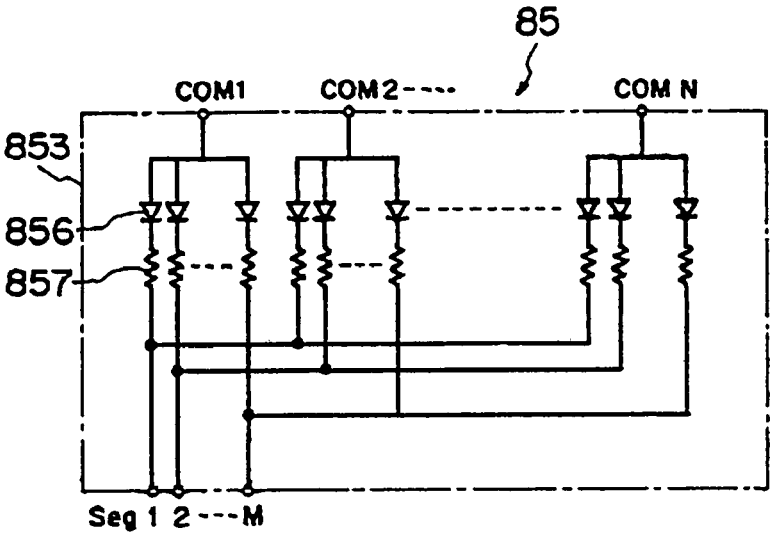
FIG. 17 is a circuit diagram of the essential portion of the ink jet substrate 85.
Figure 17B:
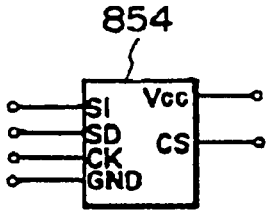
Figure 18:
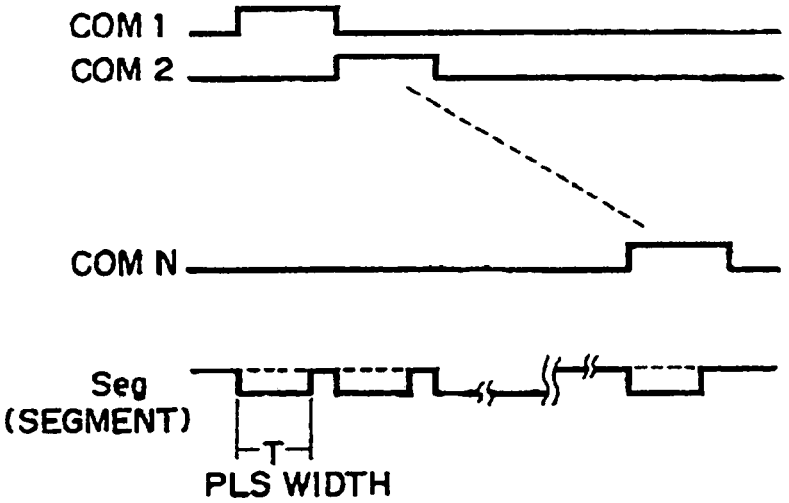
FIG. 18 is a chart for sequentially driving the heat generating element 857.

FIGS. 17A and 17B are circuit diagrams for the essential electrical circuits on the ink jet substrate 85. In FIG. 17A, the portion surrounded by a single dot chain line is the electrical circuit of the heater board 853. The heater board 853 comprises a plurality of heat generating elements 857 and a plurality of current leak prevention diodes 856, which are connected one for one in series, and are arranged in a manner to form an N×M matrix. These heat generating elements 857 are divided into a plurality of blocks, and each block is sequentially driven as shown in FIG. 18. The amount of energy supplied to drive each heat generating element 857 is controlled by changing the width (T) of the pulse applied to the segment side (Seg) of the matrix.

FIG. 17B shows an example of an EEPROM 854 in FIG. 16. In this embodiment, the data regarding failed nozzles are stored. These failed nozzle data are serially outputted to the Image processing portion of the apparatus main assembly in response to a demand signal DI (address signal) sent from the apparatus main assembly side.

Figure 21:
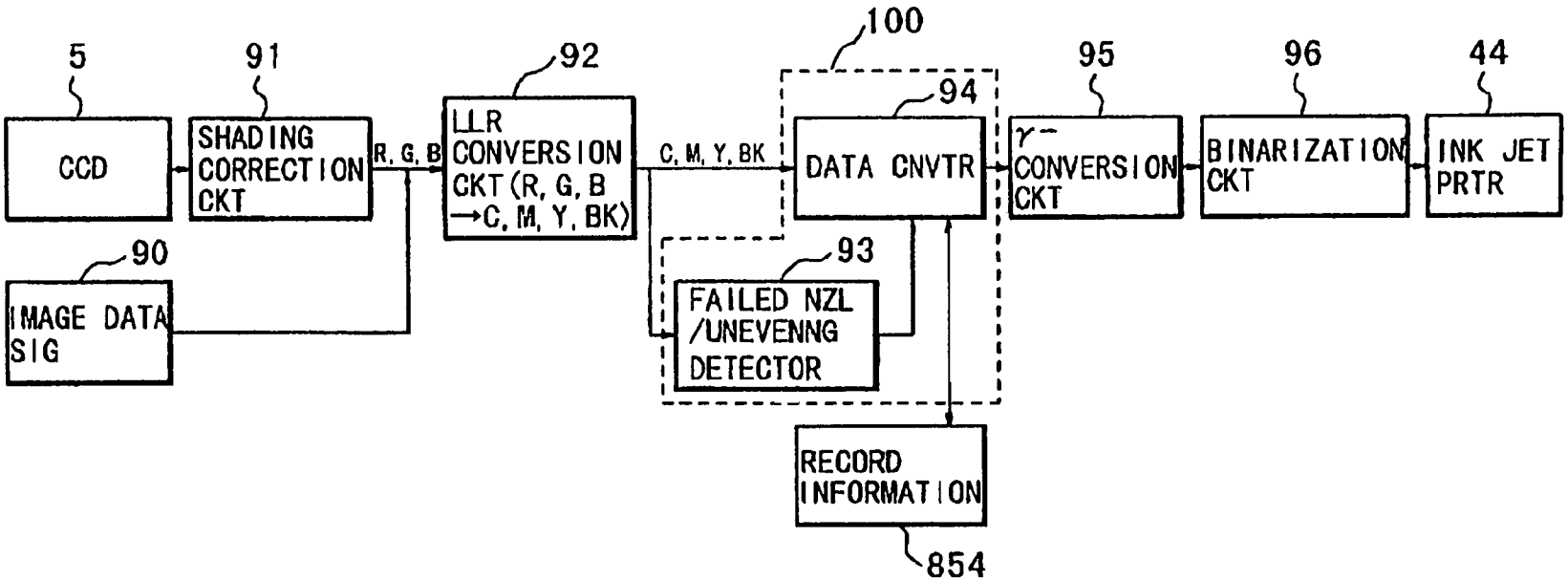
FIG. 21 is a block diagram of an image processing portion in an embodiment of the present invention.

FIG. 21 is a block diagram for showing the structure of the image processing portion in this embodiment.

Referring to FIG. 21, the image signals read in through the CCD sensor 5, or a solid state photographic element, are compensated for sensor sensitivity by a shading compensation circuit 91. Then, the image signals reflecting three primary colors, that is, red, green, and blue, of light are converted into signals for producing four primary colors for color printing, that is, cyan, magenta, yellow, and black, through a color conversion circuit 92.

Normally, this conversion is made based on a three dimensional LUT (look-up table). However, the conversion method does not need to be limited to the method employed in this embodiment. Further, as for the colors for printing, light cyan, that is, cyan with lower density, light magenta, that is, magenta with lower density, and the like may be included in addition to cyan, magenta, yellow, and black colors for printing.

Further, image data can be directly inputted into the color conversion circuit 92 from an external source.

The cyan, magenta, yellow, and black signals generated based on the red, green, and blue signals reflecting the primary colors of light are inputted into a data conversion portion 94. In the data conversion portion 94, the cyan, magenta, yellow, and black signals are modulated with the data for the failed nozzle stored in the storage medium 854 of the ink jet recording head, or the data for the failed nozzle obtained by calculation, with the use of the aforementioned failed nozzle detection pattern, and are supplied to a γ-conversion circuit 95. The characteristics of each nozzle in the ink jet head 32 are stored in the memory within the data conversion portion 94.

Figure 22:
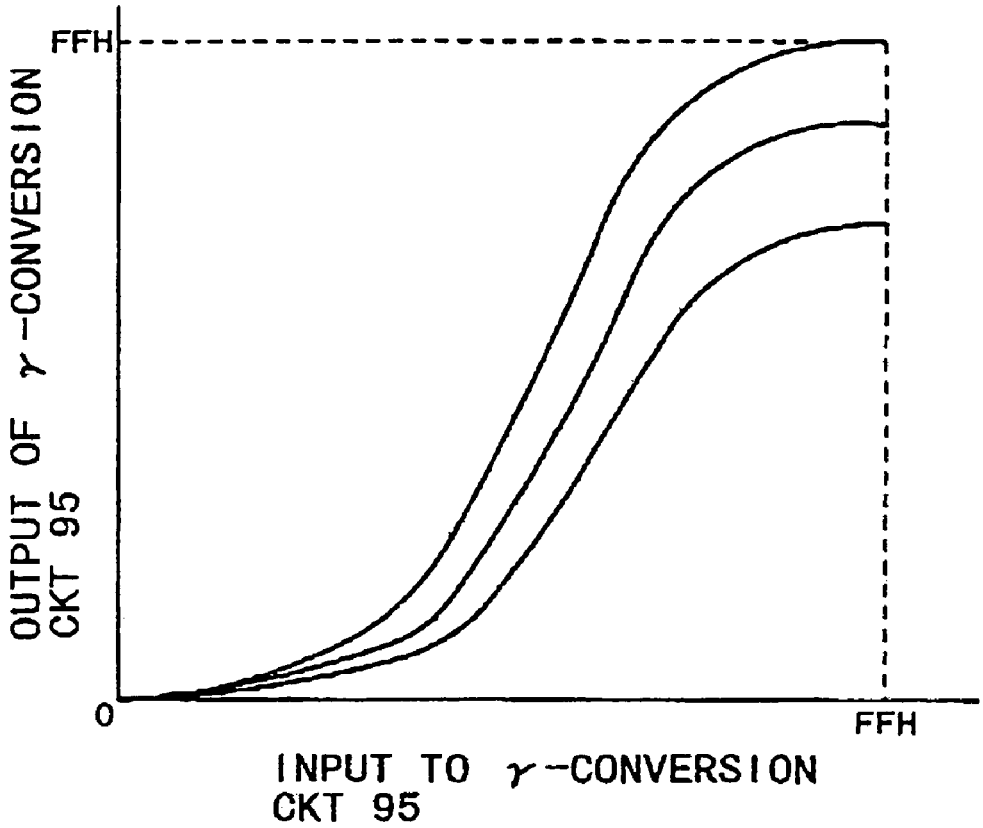
FIG. 22 is a graph for showing the relationship between the input and out of the γ-conversion circuit 95.

Referring to FIG. 22, the γ-conversion circuit 95 is provided with several functions for calculating output data based on input data. From among these functions, an appropriate one is selected according to density balance for each color, and user preference in color tone. The selection of the function is also made according to ink properties, and recording paper properties. Further, the γ-conversion circuit 95 can be included in the color conversion circuit 92. The output of the γ-conversion circuit 95 is sent to a binarization circuit 96.

In this embodiment, an error dissemination method (ED) is adopted.

The output of the binarization circuit 96 is sent to the printing portion 44, and recording is made by the recording head 32.

In this embodiment, the binarization circuit 96 is used to output an image. The application of the present Invention is not limited to the binarization circuit 96. For example, a ternary scale based circuit which produces large and small dots, or a (n+1) scale based circuit which places #0–#n dots in a single picture element, may be used. In other words, circuit selection has only to be made according to output method selection.

Next, a failed nozzle/nonuniform density detecting portion 93 and the data converting portion 94 of the data processing portion 100 which carries out the desirable part of the operation regarding the present invention will be described.

Figure 23:
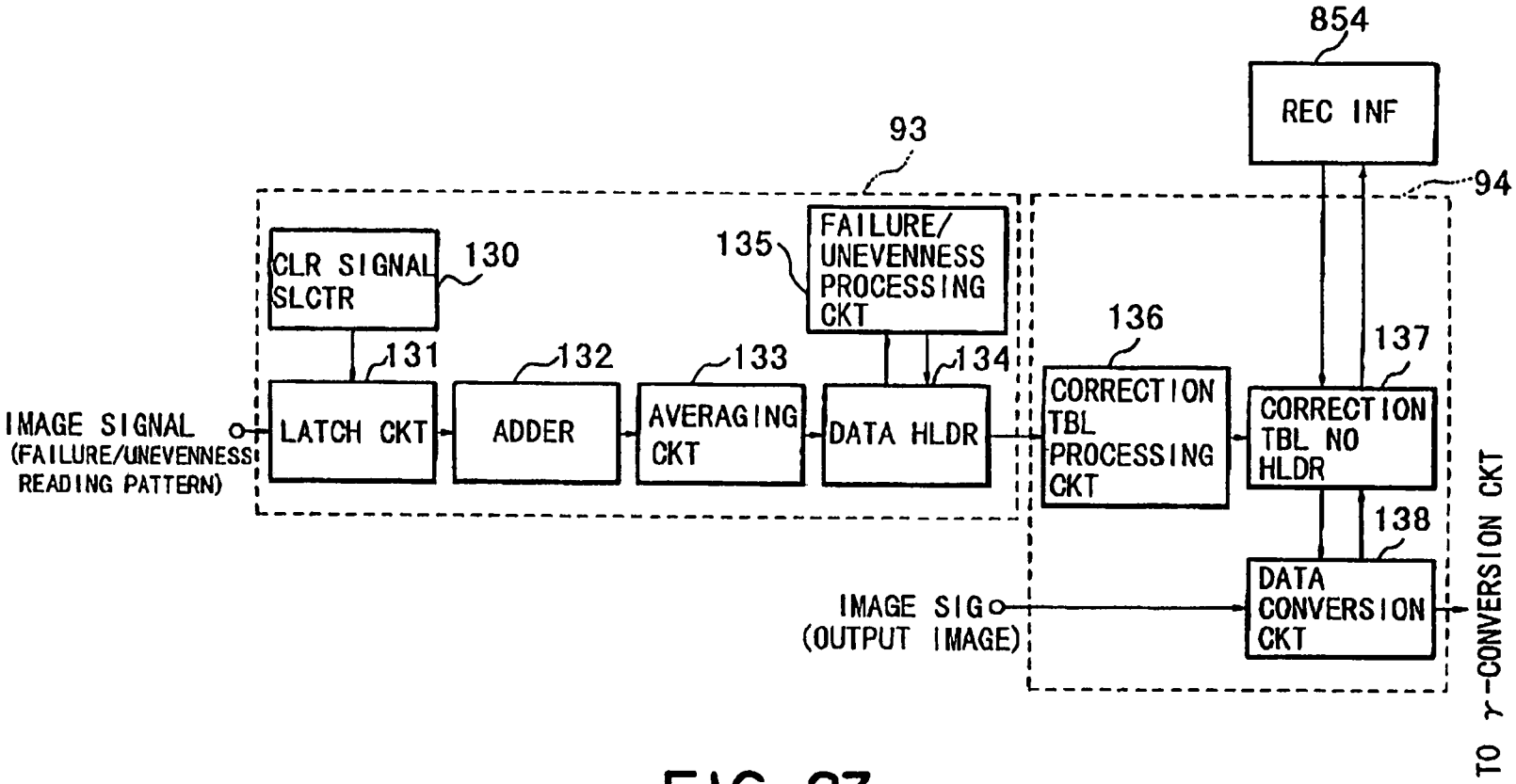
FIG. 23 is a block diagram of the essential portions of the data processing portion 100.

FIG. 23 is a block diagram for showing the data processing portion 100 in FIG. 21, and shows the essential portions and their functions. In the drawing, the left and right portions surrounded by broken lines are the failed nozzle/nonuniform density detecting circuit 93, and the data converting portion 94, respectively.

First, the operation of the failed nozzle/nonuniform density detecting portion 93 will be concretely described.

This operation comprises a process in which a pattern for detecting a failed nozzle and nonuniform density is printed, a process in which the printed pattern is read, and a process in which necessary computations are made based on the data obtained through reading of the printed test pattern. This operation is carried out when the data regarding a failed nozzle need to be renewed. However, when it is unnecessary to renew the failed nozzle data, this operation may be skipped.

In this embodiment, compensation for nonuniform density is not made. However, data regarding nonuniform density can be obtained through the failed nozzle/nonuniform density detecting portion 93, and are used in another embodiment. Therefore, the description of the compensation for nonuniform density will be given as well.

When renewing the failed nozzle data, first, the pattern for detecting failed nozzles and nonuniform density is printed. However, prior to the printing of this pattern, a head performance recovery operation is carried out. In this recovery operation, a process in which solidified ink adhering to the recording head 32 is removed, a process in which ink is suctioned through the nozzles to remove bubbles within the nozzles and to cool head heaters, and the like processes, are carried out in succession. It is highly recommended that the recovery operation is carried out as an operation for preparing the recording head 32 for printing the patter for detecting failed nozzles and nonuniform density, in its best condition.

Figure 27:
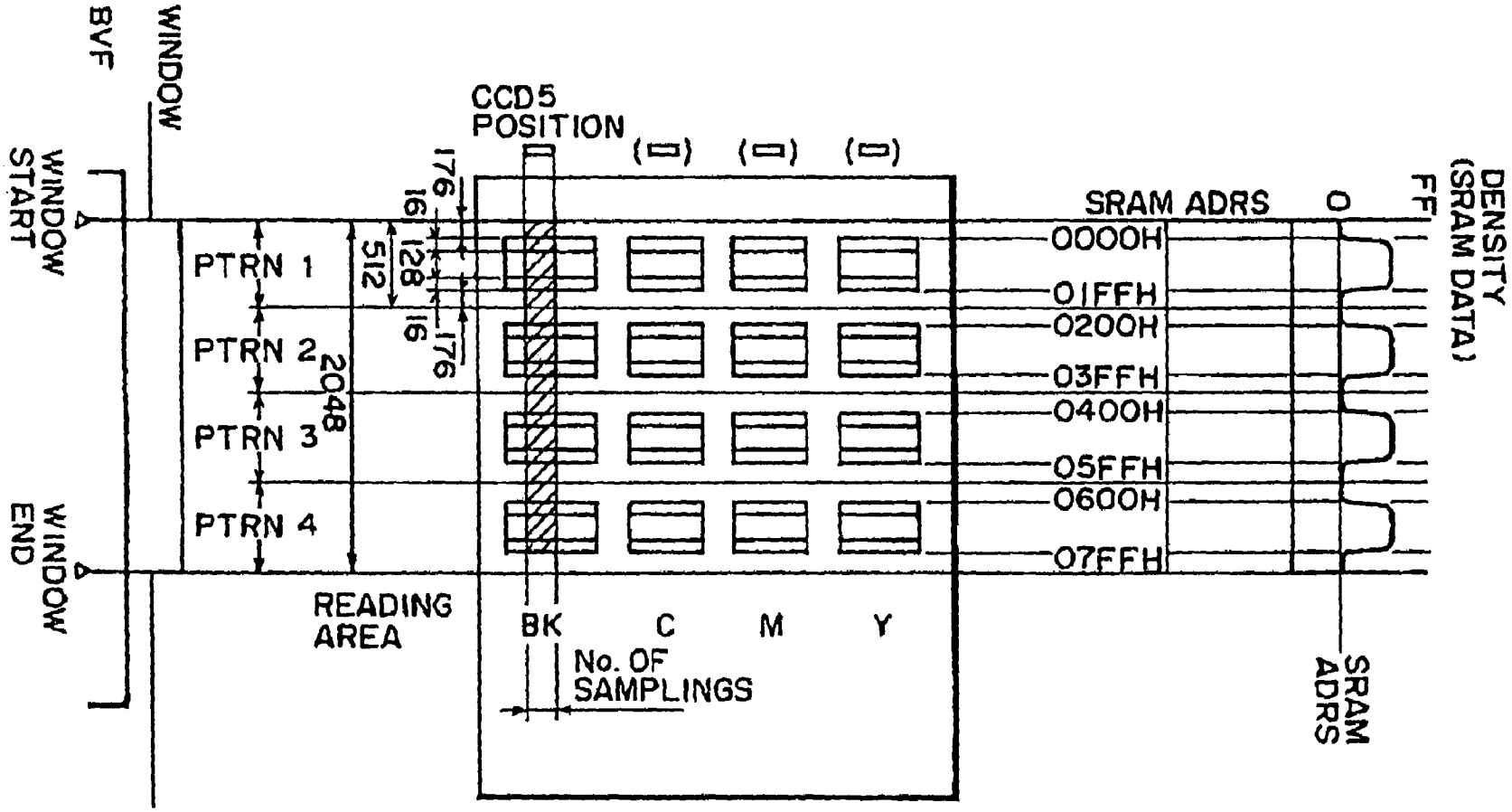
FIG. 27 is a detailed drawing of a test pattern to be printed by a recording head in order to detect a bad nozzle based on the nonuniformity detected in the printed pattern through the reading of the printed pattern.
Figure 28:
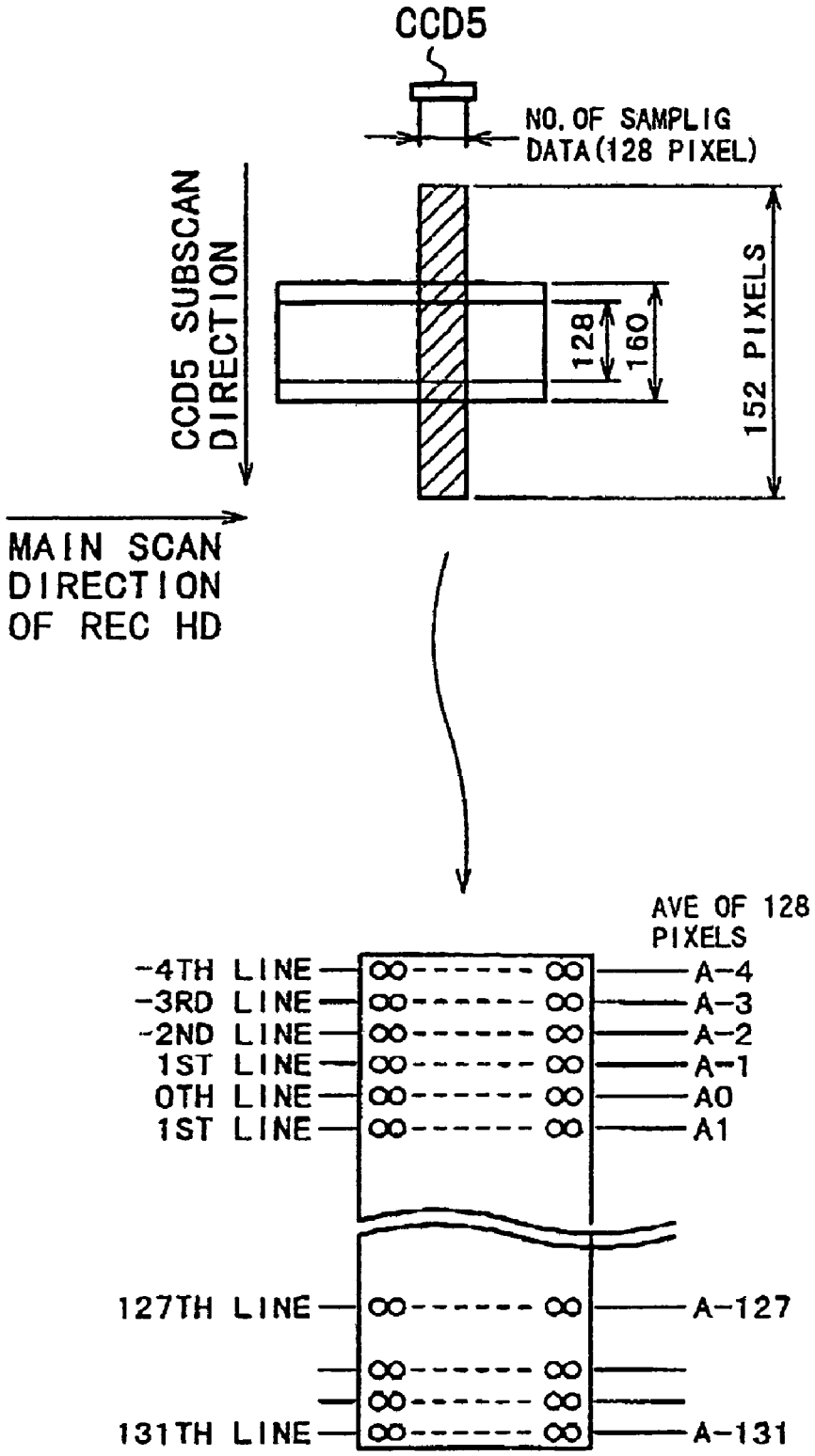
FIG. 28 is a drawing of the recording pattern of a recording head having 128 nozzles.

After the head performance recovery operation, the failed nozzle/nonuniform density detection pattern shown in FIG. 27 is printed. The pattern consists of sixteen halftone (50%) blocks: four blocks are printed for each color, being aligned in the vertical direction of the drawing. The pattern is printed on a predetermined spot on a recording sheet. Each block is finished by three scanning runs. During the first and third runs, ink is ejected from only bottom and top 16 nozzles of the recording head 32, respectively, whereas during the second run, ink is ejected from all 128 nozzles. Therefore, the width of each block is equivalent to 160 nozzles. The reason for making the width of each block equivalent to 160 nozzles is as follows Referring to FIG. 28, when the recording head 32 having 128 nozzles is used to print a test pattern to be read by the CCD sensor 5 or the like for obtaining density data An, the resultant density data, is likely to show the effects of the color of the recording paper itself on which the test pattern is printed. Therefore, if each block is finished by a single primary scan while ejecting ink from all 128 nozzle, there is a possibility that the density data for the nozzles at the top and bottom ends of the recording head 32 are not reliable. Thus, in this embodiment, the test pattern is finished through three primary scanning runs of the recording head 32 as described above, giving the pattern a width equivalent to 160 nozzles, and the area of each block, the density of which is no less than a predetermined value (threshold value) is used as the reliable test pattern area. Then, the center of this area, in terms of the vertical direction of the drawing, is deemed to correspond to the center of the recording head 32 in terms of the direction in which the 128 nozzles are aligned, and two points which are apart upward and downward from this center of the reliable test pattern by a distance equivalent to (total nozzle count)/2 (64 in this embodiment) are considered to correspond to the first and 128th nozzle, respectively.

The number of the nozzles to be used to print the top and bottom portion of the test pattern does not need to be limited to 16. In this embodiment, the number is set to 16 to save the data storage memory.

Figure 26:
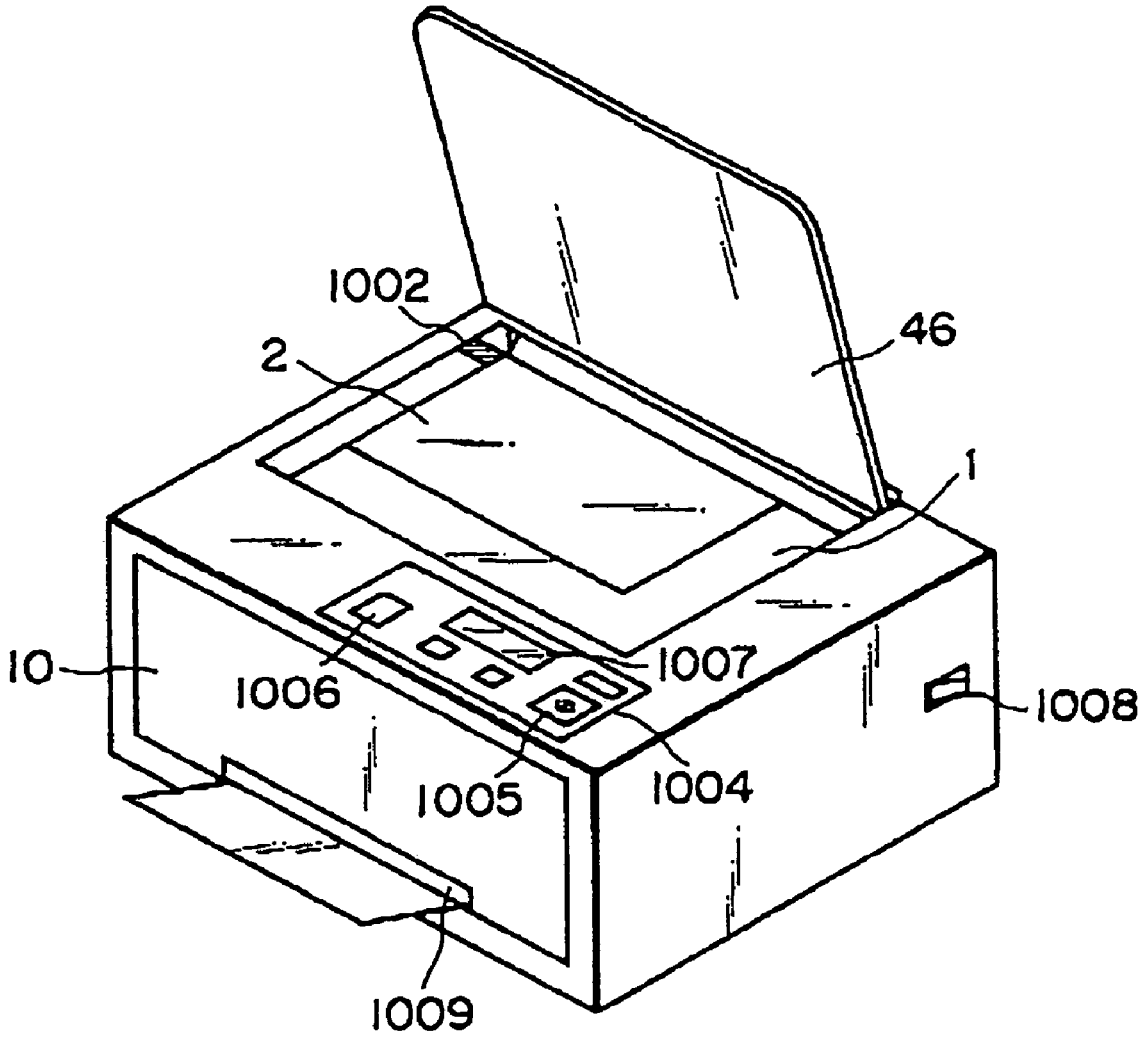
FIG. 26 is an external perspective view of the main assembly of an ink jet recording apparatus.

After the printing of the test pattern, the recording paper 2 on which the test pattern has been printed is placed on the original placement platen 1 shown in FIG. 26, in such a manner that the surface on which the test pattern has been printed faces downward, and the four blocks of the same color align in the direction parallel to the primary scanning direction of the CCD sensor 5. Then, the reading of the failed nozzle/nonuniform density detection test pattern is started.

Figure 29A:
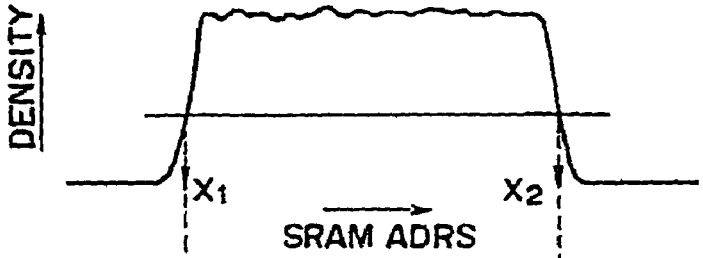
FIG. 29 is a drawing of the pattern of the print density data.

Prior to the reading of the failed nozzle/nonuniform density detection test pattern, first, the shading of the CCD sensor 5 is carried out with the use of a referential plate 1002 of white color shown in FIG. 26, and then, the reading of the failed nozzle/nonuniform density detection pattern is started. Here, one line corresponds to a single primary scanning run by the CCD sensor 5 which reads four blocks of the same color in the test pattern. Therefore, data regarding four blocks of black color, for example, are stored in the memory as the CCD sensor 5 makes a single scanning ran while reading the four blocks of the same color. As described before, the test pattern has been printed across the predetermined area of the recording paper so that the data (density data) regarding the four blocks of black color are stored across a predetermined area of the memory. Generally, the data resulting from the reading of the test pattern is in the form shown in FIG. 29(*a*), in which the axis of abscissas stands for the address of the reader, and the axis of ordinates stands for the density. Also as described before, the area of the each block, the density of which is no less than the threshold value, is used as the actual (reliable) test area. Here, it is confirmed whether or not an address X corresponding to the point in a given block, at which the density exceeded the threshold value for the first time as the reading progressed, is within an acceptable range. Assuming that the address of the edge of the block detected by the reader is X, whether or not the address X1 is within a range of X±δx is checked, and further, whether or not the density of the point corresponding to an address X1+160 is no higher than the threshold value.

When these conditions are not satisfied, there is a possibility that the test pattern (recording paper) was placed askew. Therefore, it is determined that an error has been made. Then, the reading is repeated, or the data is rotated, and the above described checking is done again. Through the above described procedure, the data are matched one for one with the nozzles. In order to find failed nozzles, the density for each picture element is picked out from within the range from X1 to X2 considered as the reliable test range, and is checked if it is no higher than the threshold value set for determining whether or not a nozzle has failed.

Figure 29B:
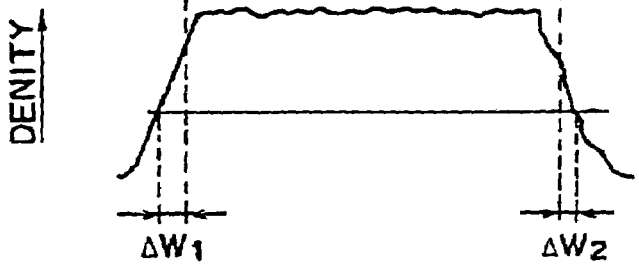
Figure 29C:
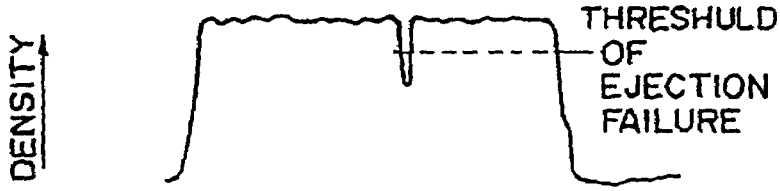

Generally speaking, when only one nozzle fails as shown in FIG. 29C, the density of the portion of an image correspondent to the failed nozzle does not drop to the level equal to the density level of the blank portion of the image. Thus, in this embodiment, a failed nozzle detection threshold is established separately from the nonuniform density detection threshold, and if the density of the portion of an image, within the reliable range, correspondent to a given nozzle is less than the this failed nozzle detection threshold, it is determined that this nozzle has failed to eject ink.

Incidentally, it is possible that when the condition of a recording head itself is unstable, some of the nozzles will suddenly fail to eject ink.

For example, when the densities of the identical spots in all four blocks of the same color are below the failed nozzle detection threshold, it is determined that the nozzle correspondent to these spots has definitely failed to eject ink. However, when a spot having a density below the threshold is found in only one of the four blocks, it is determined that the failure of the nozzle correspondent to this spot was a sporadic one. In such a case, the rest of the data may be used for computation, or it may be determined that the current operation for detecting failed nozzle/nonuniform density has errors. If it is determined that the current operation has errors, the operation is restarted from the printing of the test pattern. Instead of setting a separate threshold for determining whether or not a nozzle has failed to eject, the aforementioned threshold for finding the reliable range within each block of the test pattern may be set slightly higher so that the threshold for finding the reliable range within each block can be also used for finding a failed nozzle.

The thus obtained data are inputted into the failed nozzle/nonuniform density computing circuit 135 (FIG. 23).

The computation carried out in this embodiment is for finding a failed nozzle. Here, however, the operation for setting a density ratio for correcting nonuniform density will be described along with the operation for finding a failed nozzle.

Here, it is assumed that data having the pattern shown in FIG. 29C are inputted, and then, the steps of the operation for finding a failed nozzle will be described in the order in which they are carried out. First, the address of the center of the printed test pattern is obtained by averaging the value of the addresses X1 and X2, correspondent to the edge portions of the printed test pattern at which the density suddenly increases and decreases, respectively. It is assumed that the thus obtained address of the center of the printed test pattern corresponds to the center point between the 64th and 65th nozzles. Thus, the data located away from the center address by a distance equivalent to 64 picture elements in the directions of the top and bottom ends of the recording head 32 correspond to the densities of the portions recorded by the first nozzle and 128th nozzle, respectively. With this calculation, the print density n(i) for each nozzle, inclusive of the borders between the portions of each block printed through the first and second scanning runs of the recording head 32, and between the portions of the same block printed through the second and third scanning runs of the recording head 32, is obtained. At this point, if the print density n(i) of any nozzle is less than the failed nozzle detection threshold, it is determined that this nozzle has failed to eject ink, and the density ratio data d(i) for this nozzle is set to zero: d(i)=0. In this embodiment, the computation of the density ratio, which will be described next, is not carried out. Therefore, the density ratio data for other nozzles are set to one: d(i)=1.

Density ratio data are set in the following manner.

First, the average density AVE of all nozzles except for the failed nozzle, and the ratio of the density of each nozzle relative to the average density AVE is used as the density ratio data for each nozzle: d(i)=n(i)/AVE.

Figure 31:
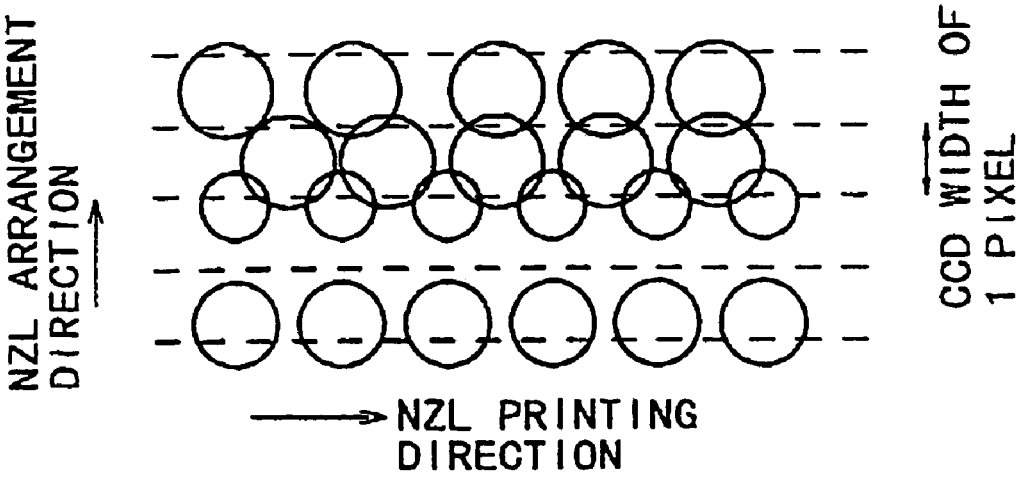
FIG. 31 is a detailed drawing of a given portion of the test pattern, which is being read.
Figure 32:
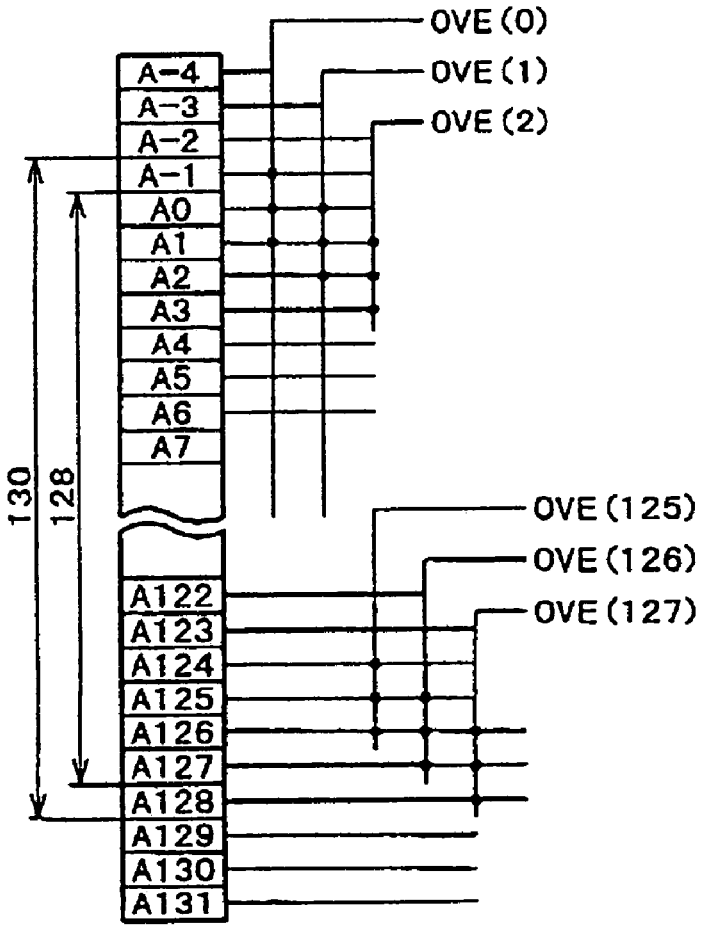
FIG. 32 is a drawing for describing the density data for picture elements.

However, it is very risky to use the density ratio data defined as described above for each nozzle, in other words, the data obtained based on the density data correspondent to an area having a size equivalent to only a single picture element, without modification. This is due to the following reason. That is, referring to FIG. 31, the measured density of each picture element in each block of the test pattern definitely reflects the density of the dots formed by the nozzles sandwiching the nozzle which formed the image portion, the density of which is measured. Further, it is inevitably that each nozzle is slightly offset in the left or right direction. In addition, it is desirable to take into consideration the fact that the manner in which human eye detects density nonuniformity in a particular area of a print is affected by not only the condition of the particular area, but also the conditions of the adjacencies of the particular area.

Therefore, it is desired that the following method is used. That is, before determining the density for each nozzle, the average density of each nozzle and the immediately adjacent two nozzles, in other words, the average of the density data for three picture elements (Ai−1, Ai, Ai+1,) is obtained, and this average density ave(i) is used as the nozzle density for the nozzle. Then, the density ratio data d(i) for each nozzle is set based on this average density data eve(i): d(i)=aver (i)/AVE. Thus, in reality, this density ratio data are used to create a correction table, which will be described later.

The density ratio data d(i) are process by a correction computation table 136 (FIG. 23), to create a correction table for each nozzle.

| Representing the table number with T(i), T(i) = | |
|---|---|
| #63:1.31 < d(i) | |
| #(d(i) − 1) × 100 + 32:0.69 < d(i) < 1.31 | |
| #1 | 0 < d(i) < 0.69 |
| #0 | d(i) = 0. |

Figure 24:
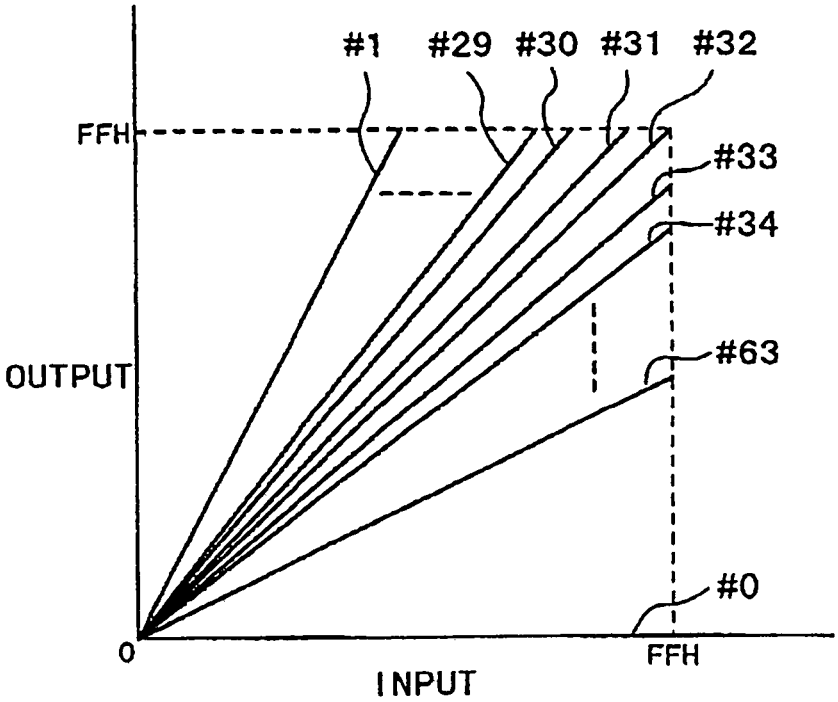
FIG. 24 is a graph for showing the examples of the density correction tables for some nozzles.

Here, 64 correction tables #0–#64 are prepared as shown in FIG. 24. In Table 32, the input value is always equal to the output value. Thus, the line in FIG. 24 representing Table 32 is a straight line having an inclination of 1. This Table 32 is the table used for nozzles which record in the average density of 128 nozzles. The table inclination gradually increases or decreases as the value of the table number decreases or increase, depending on which side of Table 32 a given table is. More specifically, in Table 32, the output value is equal to the input value which is 50% (80 H), or the density of the test pattern, whereas the output value in the rest of the tables is increased or decreased by 1% as the value of the table number decreases or increases, depending on which side of Table 32 a given table is. Thus, an input signal which is always at 80 H is converted into an output signal at the ratio in Table T(i). The table number #0 corresponds to a failed nozzle, and therefore, the output value has been set to zero.

The process for creating a correction table for each nozzle is ended after 128 correction tables are created for 128 nozzles, one for one.

In this embodiment, the above described process for determining density ratio is not carried out. Instead, Table #0 or Table #32 is prepared for all nozzle.

After the completion of the reading of the four blocks of the same color in the test pattern, that is, a single scanning run over the test pattern in the primary scanning direction of the reader, and creation of a correction table for each nozzle, the same operation is repeated for the three other column of blocks in the test pattern. In other words, the above described operation is carried out for four colors. After the correction tables for all four colors are created, the correction table number holding portion 137, into which the recording head number has been read from the storage medium 854, is renewed; the contents in the correction table number holding portion 137 and recording head data storage medium 854 are replaced with the newest correction table numbers.

Thus, when the operation for detecting failed nozzles and nonuniform density is not carried out, the correction table numbers which have been stored in the recording head data storage medium 854 are used in the following processes.

Figure 9:
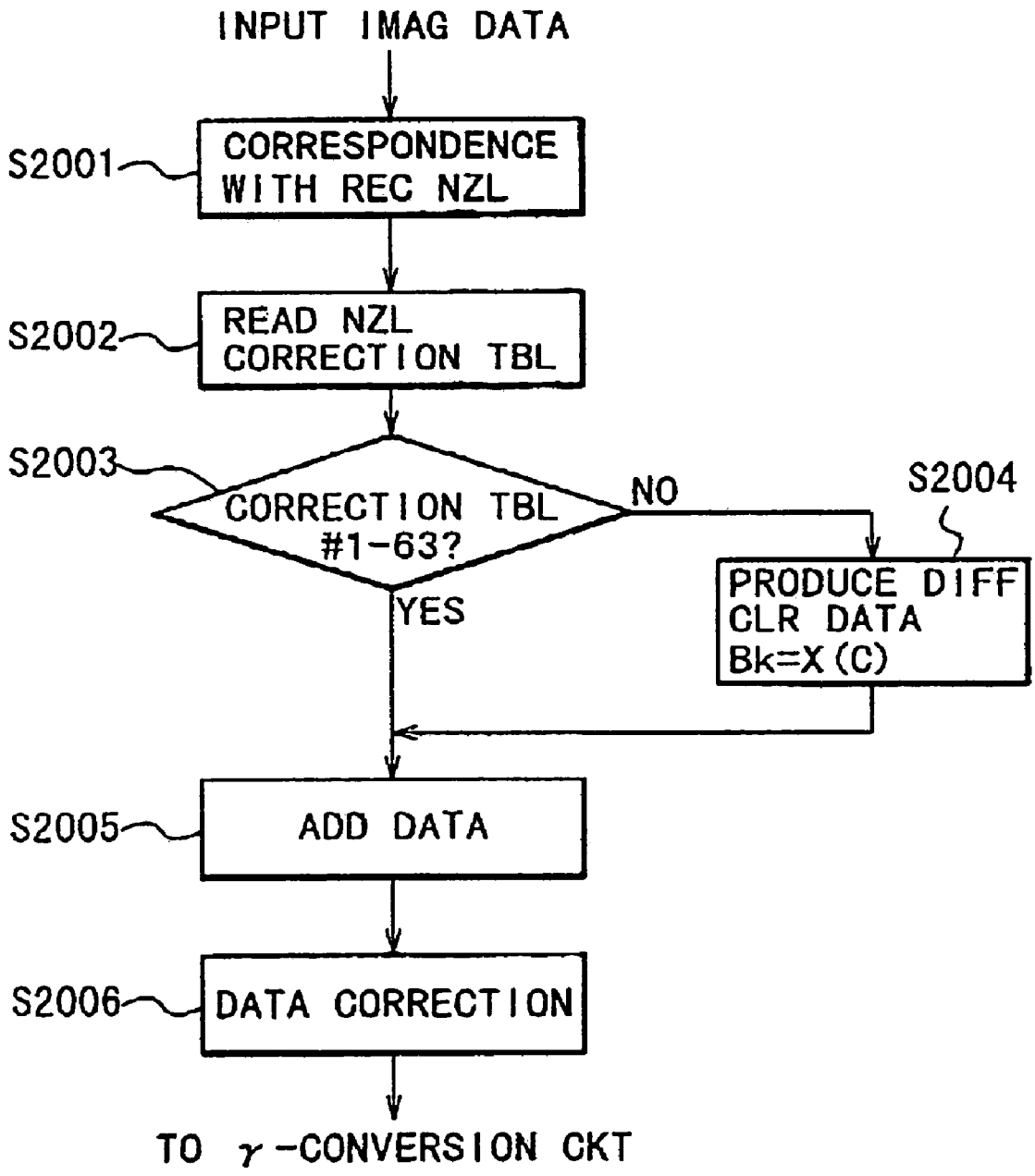
FIG. 9 is a flow chart of the operation carried out by a data conversion computation circuit.

In the data conversion computation circuit 138, inputted image signals are converted into signals for driving nozzles, with the use of the above described correction tables. The flow of this process is shown in FIG. 9.

After being inputted into the data converting portion 94, cyan, magenta, yellow, and black image signals are assigned to the nozzles which actually record an image. Further, data regarding the colors assigned to each picture element while recording are selected and processed together.

Then, the density correction table for each nozzle is looked up, and the data are converted. This data conversion is carried out in two different manners, depending on whether the correction table number falls between #1–#63, inclusive of #1 and 63, or is #0, in other words, when a given nozzle has failed.

When the correction table number is one of #1–#63, input signals are sent to a data adding portion of each color, without modification.

On the other hand, when the correction table number is #0, in other words, when a given nozzle has failed to eject ink, data for compensating for this nozzle are created. For example, when an input signal is for cyan color, #C-K compensation table Is used to create data for a nozzle for black color ink, and when an input signal is for magenta color, #M-K compensation table is used to create data for a nozzle for black ink. However, when an input signal is for yellow color, data for a nozzle for black ink are not created. Further, when an input signal is for black color, data for a nozzle for cyan ink, a nozzle for magenta ink, and a nozzle for yellow ink are created using the Bk-cmy compensation table.

In this embodiment, these compensation tables are created so that compensation is made to approximately match in brightness the portion of an image correspondent to the failed nozzle, to the surrounding areas. FIG. 5 is a graph which shows the relationship between output value in brightness and the input value, for each of four colors. The compensation tables have been created based on this graph. For example, if the value of the data for cyan color is "192" (eight bit input), corresponding brightness is approximately "56."

On the other hand, an eight bit input value at which the brightness for black color becomes approximately "56" is approximately "56" (Bk=56). Therefore, C=192 is converted into Bk=56. FIG. 6 shows the conversion table for converting data for cyan color into data for black color, along with the conversion table for converting data for magenta color into data for black color.

Compensation is not made for a nozzle for yellow color in consideration of the fact that yellow color is very high in brightness. The compensation for a given nozzle for black ink is made by converting the data for the nozzle into data for nozzles for cyan, magenta, and yellow nozzles, which correspond to the given nozzle, at an equal ratio. The thus obtained compensation table is also shown in FIG. 6, being represented line #Bk-cmy.

The compensation data are created using these, compensation tables. However, it is desired that the relationship between the diameter of each dot to be recorded and the picture element pitch is taken into consideration. For example, in this embodiment, the diameter of each dot to be recorded is approximately 95 μm, and the picture element pitch is 63.5 μm. These specifications are set to assure that when recording is made at 100% density, an area factor of 100% is accomplished even if some ink droplets land slightly off their targets.

Thus, when only one nozzle has failed, the appearance of the picture element to which the failed nozzle corresponds is considerably affected by the dots which belong to the two picture elements sandwiching the first picture element.

In other words, the dots recorded on the portion of an image correspondent to the failed nozzle substantially affect the picture elements sandwiching the picture element to which the failed nozzle corresponds.

This means that, except for a situation in which two or more consecutive nozzles have all failed, data for compensating for a failed nozzle may be smaller in value than the value of the data obtained strictly based on brightness.

Figure 7:
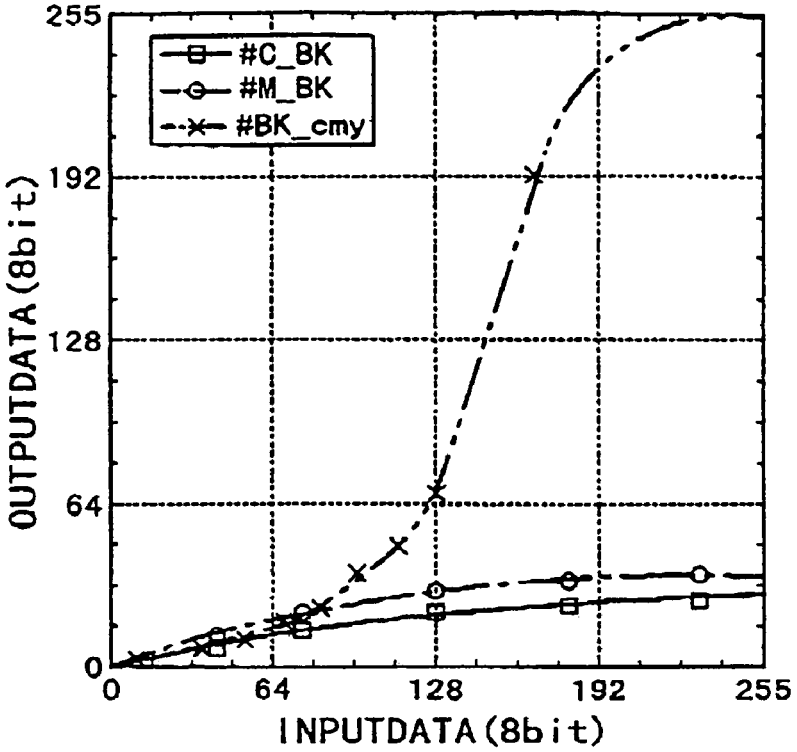
FIG. 7 is a graph showing the tables used for compensating for a bad nozzle with the use of a nozzle different in ink color from the bade nozzle.

Therefore, in this embodiment, the compensation table shown in FIG. 7 is used.

Incidentally, different compensation tables may be prepared to deal with different situations, for example, when only one nozzle has failed to eject ink, when two consecutive nozzles have failed to eject ink, or when three consecutive nozzles have failed to eject ink. With the provision of such tables, compensation for a single or plural failed nozzles can be more precisely made based in terms of brightness.

For example, it is desired that when only one nozzle has failed to eject ink, the compensation table shown in FIG. 7 is used; when two consecutive nozzles have failed to eject ink, such a compensation that fits between the compensation tables shown in FIGS. 6 and 7 is used; and when three consecutive nozzles have failed to eject ink, the compensation table shown in FIG. 7 is used for the two end nozzles, and the compensation table shown in FIG. 6 is used for the center nozzle.

The created compensation data for each color are sent to the data adding portion.

The data adding portion is capable of holding data for each color, and also carrying out necessary computations. When the data having been inputted into the data adding portion are the first batch of data, this batch of data is held without modification.

However, when another batch of data are already in the data adding portion, the new batch of data is added to the existing batch of data. If the sum of the data exceeds 255 (FFH), the data are held as 255. In this embodiment, two batches of data are simply added. However, various other computations may be carried out, or data may be processed using tables, as necessary.

After the data for cyan, magenta, yellow, and black colors are all added, the sum of the data are sent to the data correcting portion, and the data adding portion is reset to be prepared for processing the data for next picture element. The data sent to the data correcting portion are converted according to the correction table (#0–#63) which corresponds to the nozzle for which compensation is made. This concludes the data conversion sequence.

The data obtained through the above described data conversion process are sent to corresponding nozzles through the γ-conversion circuit 95, binarization circuit 96, and the like, to output an image.

An image printed through the above described process was so good that the portion of the image correspondent to a failed nozzle could be detected only when it is intensely stared from a close distance.

(Embodiment 2)

<Compensation by Head Shading>

In this embodiment, compensation for a bad nozzle, which is made to reduce nonuniformity in image density, is made by head shading. Next, head shading will be more concretely described.

The system used in this embodiment for compensating for a bad nozzle is virtually the same as the one used in the first embodiment, except that in this embodiment, the data for filling the portion of an image correspondent to a bad nozzle, with the use of a nozzle different in ink color from the bad nozzle are not created.

Hereinafter, the data conversion process, that is, the process carried out by the combination of the a bad nozzle/nonuniform density detecting portion 93 and the data converting portion 94, will be described with respect to these two points.

Figure 30:
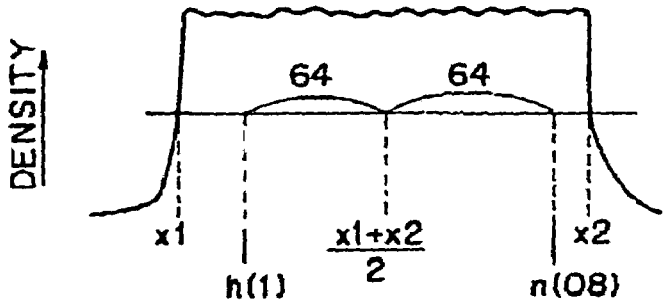
FIG. 30 is a drawing for showing the relationship between the pattern of the print density data and the nozzle position.

Referring to FIG. 21, the process carried out by the bad nozzle/nonuniform density detecting portion 93 is basically the same as that in the first embodiment. Referring to FIG. 23, first, a test pattern, which is read for detecting a bad nozzle/nonuniform density, is printed, and this test pattern is read with the use of the CCD sensor. Then, the data obtained by the reading are subjected to such processes as adding, averaging, and the like. As a result, print density n(i) is obtained for each nozzle, as shown in FIG. 30.

First, in order to make it easier to understand this embodiment, the basic cause of the occurrence of nonuniformity in image density will be described.

Figure 19A:
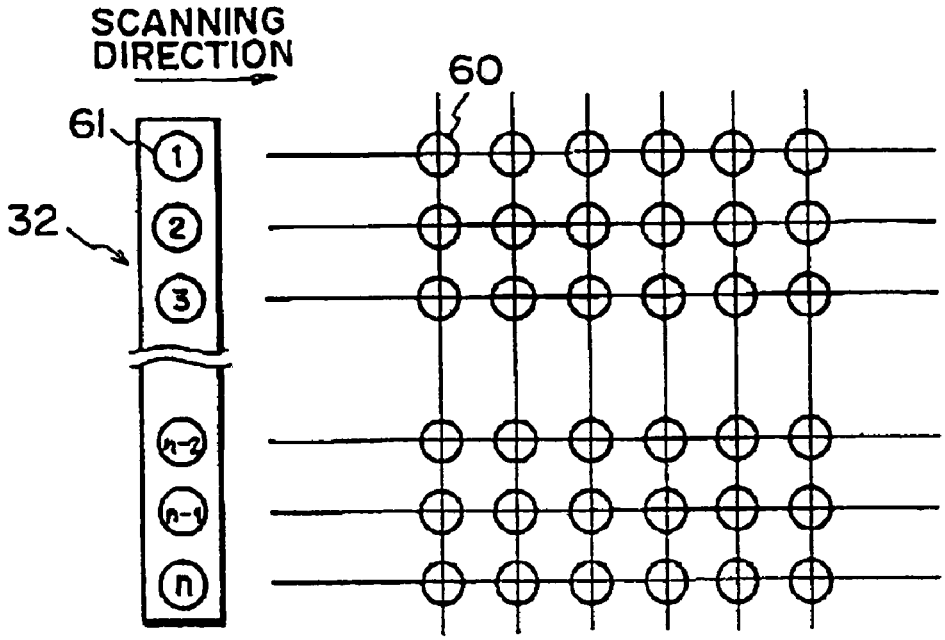
FIG. 19 is a drawing for showing the manner in which recording is made.

FIG. 19A is an enlarged drawing of a given portion of an image printed by an ideal recording head 32. In the drawing, a referential code 62 designates an orifice through which ink is ejected. As is evident from the drawing, when recording is made with the use of this recording head 32, a plurality of ink spots 60 are created, being arranged in a predetermined pattern, on a recording paper, by the same number of ink droplets, one for one, which are virtually identical in diameter.

This drawing shows the case in which recording was made by opening all nozzles. However, even if output is reduced to 50% to form a halftone image, for example, an image with uniform density can be formed as long as the ideal recording head is used.

Figure 19B:
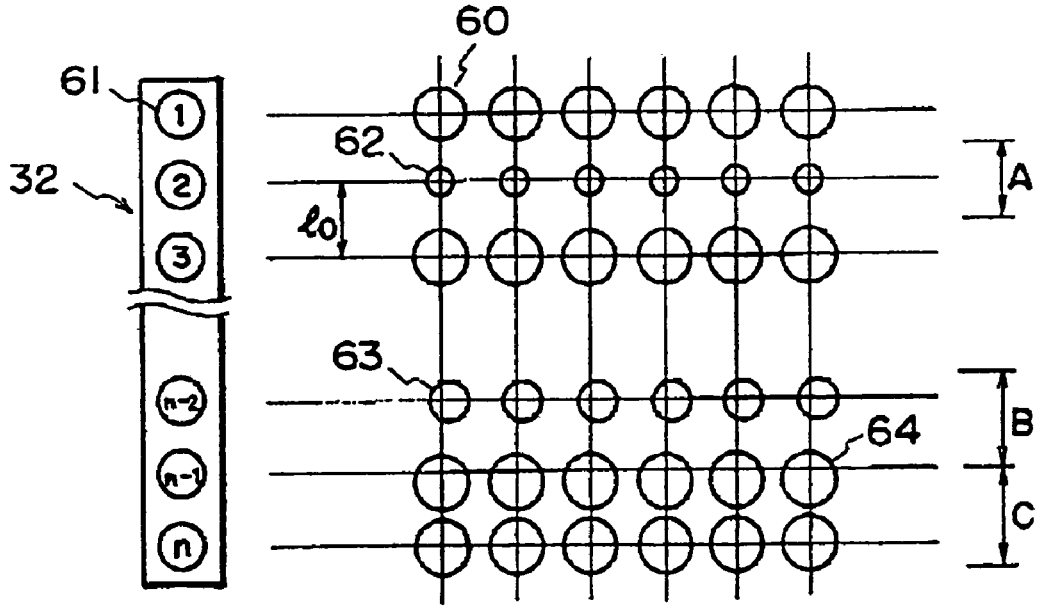

In comparison, the case shown in FIG. 19B, spots 62 and 63, that is, the spots created by th second and (n−2)-th nozzles ate smaller in diameter than others. Further, the spots 63 and 64 created by the (n−2)-th and (n−1)-th nozzles are offset from the ideal landing spots for the ink droplets from the (n−2)-th and (n−1)-th nozzles, respectively. More specifically, the spot 63 correspondent to the (n−2)-th nozzle is offset upward to the right, and the spot 64 correspondent to the (n−1)-th nozzle is offset downward to the left.

As a result, a region A in FIG. 19A appears as a line with a light tone. As for regions B and C, the distance between the centers of the spots correspondent to the (n−1)-th and (n−2)-th nozzles is greater than the average distance 10 between the centers of the adjacent two normal spots in terms of the direction in which the nozzle orifices are aligned, and therefore, the region B appears as a line lighter in toner from the surrounding regions, whereas the distance between the centers of the spots correspondent to the (n−1)-th and n-th nozzles is smaller than the average distance 10, and therefore, the region C appears as a line darker in toner than the surrounding regions.

As is evident from the above, nonuniformity in density results from the error in the diameter of the dot formed by an ink droplet, and the error in the position of the dot formed by an ink droplet (which is commonly called "positional deviation").

As a means for dealing with the occurrence of this nonuniform density, there is an effective method, according to which the image density of a give region of an image is detected, and the amount of the ink ejected into this region is controlled according to the detected value of the image density of this region.

Figure 20A:
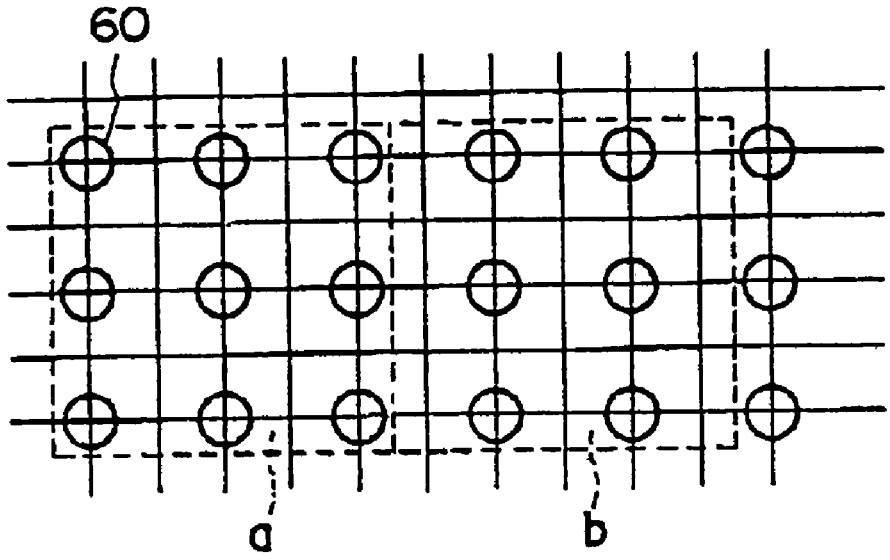
FIG. 20 is a drawing for showing the manner in which a recording head records in halftone (50%).
Figure 20B:
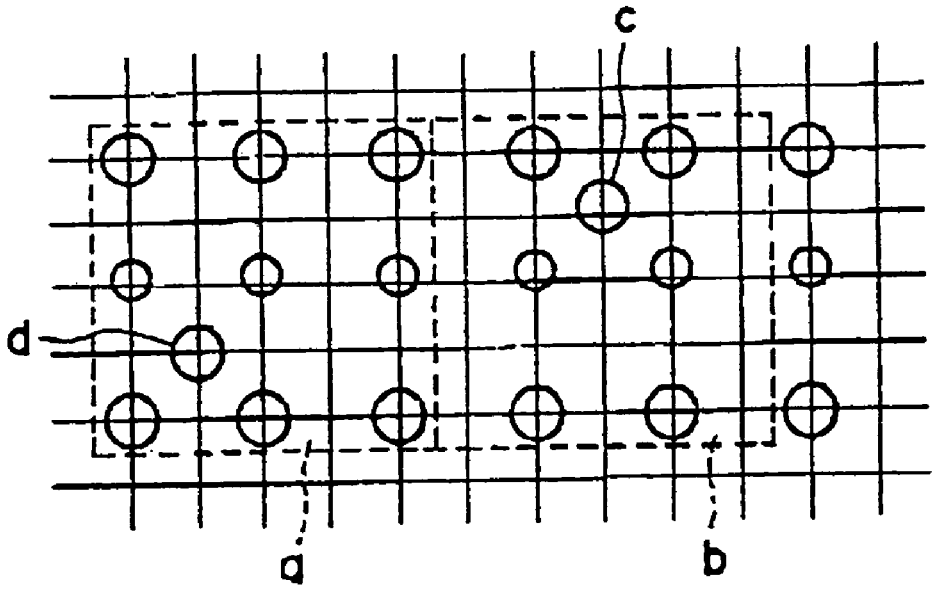

More specifically, in order to print an image which is reasonably uniform in density, with the use of a recording head which was designed to record in the manner (ideal manner) shown in FIG. 20A in halftone at 50% density, but records with "dot diameter error" and "positional deviation" as shown in FIG. 20B, the following measures are taken. One method is to control a recording apparatus in such a manner that the total area covered by the dots, within the area surrounded by the broken line a in FIG. 20B, will become as close in size as the total area covered by the dot, within the area a in FIG. 20A. With the use of such a control, even when the recording head characterized in ejection pattern as shown in FIG. 20B is used to record an image, the density of the resultant image will appear to the human eye as if the image would have been recorded as shown in FIG. 20A.

If the same control is executed for the area b in FIG. 20B as well, the effects of this recording head will be practically eliminated.

FIG. 20B was drawn to simplify the explanation of the density correction control, and shows the results of the control. In FIG. 20B, designated by referential codes c( and P are dots placed for the correction.

It should be noted here that this system can also be applied to a dead nozzle by presuming that the diameter of the dot formed by the dead nozzle has becomes infinitely close to zero.

From this standpoint, it is desirable that the density ratio data for each nozzle are as follows, similarly to those in the first embodiment.

$$d(i) = ave(i)/AVE$$

$$ave(i) = (n(i-1) + n(i) + n(i+1))/3$$

$$AVE = \sum_{i}^{128} (n(i)/128)$$

In other words, when nozzle io is dead, n(io) is set to d(io): n(io)=d(io). As a result, the effective densities ave (io+1) and (io−1) of the nozzles (io+1) and (io−1), respectively, take much smaller values compared to those of the n(io+1) and n(io−1). Consequently, the density ratio data d(io+1) and d(io−1) become smaller in practical terms, and therefore, are controlled in a manner to effect higher density, based on the correction table which will be described later, in order to compensate for the dead nozzle. Therefore, the mathematical formula for calculating the effective density ave (i) for each nozzle does not need to be limited to the aforementioned mathematical formula for calculating the average value of the densities of a given picture element and the picture elements sandwiching the given picture elements. For example, a formula such as ave (i)=(2n (io−1)+2n (io+1))/5 may be used to obtain a weighted average value. In other words, selection may be made according to circumstances.

The thus obtained density ratio data d(i) are processed by the correction table computation circuit 136 in the data conversion portion 94 to prepare a correction table for each nozzle. This process is the same as that in the first embodiment, and therefore, the detailed description of this process will be skipped here.

Figure 25:
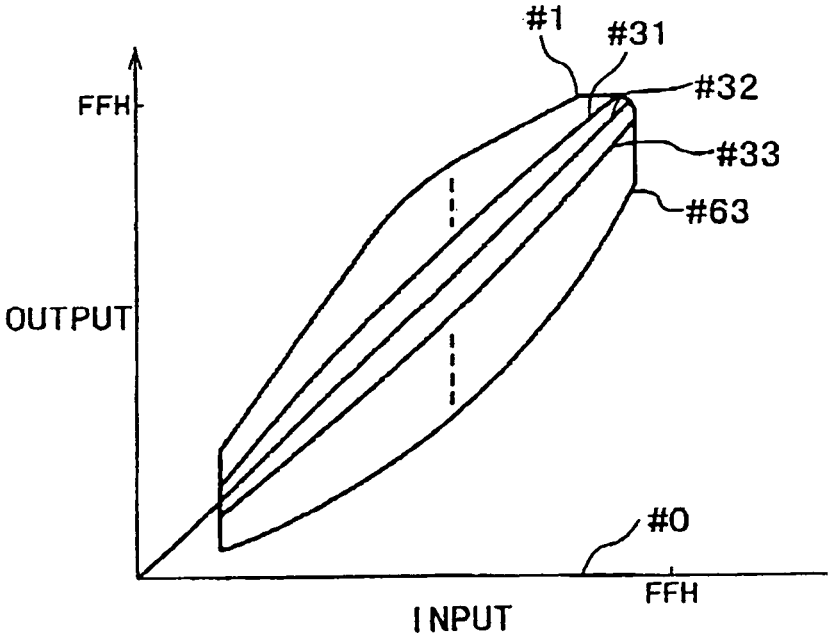
FIG. 25 is a graph for showing the examples of the nonlinear density correction tables for some nozzles.

There are 64 correction table lines in FIG. 24, the number of the correction tables may be increased or decreased as necessary. Further, nonlinear correction tables such as those shown in FIG. 25 may be employed depending on the type of medium onto which ink is ejected and/or ink properties.

After creating a correction table for each of the entire nozzles as described above, the contents of the correction table number holding portion 137 and storage medium 854 of the recording head are renewed. The conversion of the data for outputting an image are carried out by the data conversion computation circuit 138 based on the thus created correction tables, that is, the renewed contents of the correction table number holding portion 137 and storage medium 854 of the recording head. These conversions are virtually the same as those in the first embodiment. However, in this embodiment, compensation for a bad nozzle is not made with the use of a nozzle different in ink color, and therefore, the conversion process in this embodiment is much simpler.

In other words, the flow of the conversion process in this embodiment is virtually the same as the one shown in FIG. 9, except that it lacks a step (step S2003 in FIG. 9) in which data are matched one for one with nozzles, a step (step S2005 in FIG. 9) in which data for making compensation with the use of a nozzle different in ink color are created, and a step (step S2006 in FIG. 9) in which the data are added. The correction data obtained through the process described above are put through the y conversion circuit 95 if necessary, and are binarized through the binarization circuit 96, to be used for outputting an image.

An image formed through the above described process was an excellent one, showing virtually no effect of the ejection failure, in particular, in the highlight portions of the image.

(Embodiment 3)

This embodiment is a combination of the first embodiment in which compensation for a bad nozzle is made with the use of a nozzle different in ink color from the bad nozzle, and the second embodiment in which compensation for a bad nozzle is made by head shading. Thus, the same systems as those in the first and second embodiments can be used for this embodiment.

Hereinafter, the data conversion process in the printing operation in this embodiment will be described.

Referring to the block diagrams in FIGS. 21 and 26, the operation carried out in the failed nozzle/nonuniform density detecting portion 93 in this embodiment is the same as that in the second embodiment. In other words, the printing of a failed nozzle/nonuniform density detection test pattern, reading of the failed nozzle/nonuniform density detection test pattern, detection of bad nozzles, calculation of print density for each nozzle, and calculation of the density ratio data for each nozzle, are done.

The thus obtained density ratio data are processed by the correction table computation circuit 136 of the data converting portion 94, in the same manner as in the first embodiment, to create a correction table for each nozzle. Then, the contents of the correction table number holding portion 137 and the storage medium 854 of the recording head are renewed with the correction tables created by the correction table computation circuit 136, and the renewed contents are used by the data conversion computation circuit 138. The process carried out in the data conversion computation circuit 138 is basically the same as that in the first embodiment (FIG. 9).

This embodiment is different from the first and second embodiments in only the contents of the correction table used for compensating for a failed nozzle, that is, a nozzle having a correction table number of #0, with the use of a nozzle different in ink color from the failed nozzle. In other words, in this embodiment, the compensation for a failed nozzle by head shading is carried out in a manner to correct the print densities of the nozzles sandwiching the failed nozzle in the direction to compensate for the failed nozzle, and therefore it is desired that the compensation by a nozzle different in ink color from the failed nozzle be not made while the highlight portion of an image is recorded, that is, while recording is made at a relatively low duty. Further, while the shadow portion of an image is recorded, that is, while recording is made at a relatively high duty, compensation for the failed nozzle is made by the nozzles sandwiching the failed nozzle as described above, and therefore, the need for the compensation for the failed nozzle by a nozzle different in ink color from the failed nozzle is relatively small. Thus, in this embodiment, data conversion is made using the different color based compensation table in FIG. 8.

In other words, in this embodiment, a larger number of dots are placed on the areas of a recording medium correspondent to the nozzles sandwiching a failed nozzle, through the aforementioned head shading, compared to when the compensation is not made, and therefore, the number of the dots to be placed for compensating for a failed nozzle by a nozzle different in ink color from the failed nozzle can be reduced. For example, FIG. 4 shows the images of the correction tables. When the input values are as shown in FIG. 24, the print densities for the nozzles sandwiching a failed nozzle are increased to 1.5 times (correction line 4*b*) the original densities, compared to when no compensation is made (correction line 4*a*), in order to compensate for the failed nozzle. This correction corresponds to FIGS. 4(*a*), 4(*b*), and 4(*d*). The size of each cell of the grids in FIGS. 4(*a*), 4(*b*), 4(*c*), and 4(*d*) represents the size of an area in which four dots are recorded. In other words, FIG. 4(*a*) shows the dot distribution pattern for a relatively low print duty, in which a single dot is placed per cell of the grid.

The recording head for printing the dots shown in FIG. 4 has a plurality of nozzles aligned in the vertical direction of the drawing. FIG. 4 shows the case in which the nozzle correspondent to the third dot from the top has failed to eject. In the drawing, a circle drawn in a solid line represents the position of the dot recorded by a normal nozzle, and a circle drawn in a fine broken line represents the position of the dot which would have been recorded by a failed nozzle if the failed nozzle had not failed. Further, a circle drawn in a bold broken line represents the dot recorded for compensating for the failed nozzle. As is evident from this drawing, it is desired that the print duty of the nozzles sandwiching the failed nozzle be increased to 1.5 times the original print duty.

However, a white line is more conspicuous in an image high in dot density than in an image low in dot density. Further, the size of a dot formed when an ink droplet of a given size is ejected onto a certain type of recording medium is smaller than the size of a dot formed when an ink droplet of the same size is ejected onto the other types of recording medium. Therefore, when recording is made on the former type of recording medium, even If recording is made at a duty higher than ½ duty, a white line is conspicuous. Thus, when recording is made at a relative high duty, the portion of an image correspondent to the failed nozzle is filled with dots different in color from the dots which would have been placed by the failed nozzle if it had not failed, so that the portion of the image correspondent to the failed nozzle will be inconspicuous. More concretely, in this embodiment, when recording at ⅔ (75%) or higher duty, compensation for a failed nozzle is made in such a manner that the duties for the nozzles sandwiching the failed nozzle are kept at 100%, or their original duties, whereas the portion of an image correspondent to the failed nozzle is filled with dots different in color from the dots which would have been placed if the failed nozzle had not failed. In principle, in order to print an image so that the portion of the image correspondent to the failed nozzle will turn out inconspicuous, with the use of only the nozzles sandwiching the failed nozzle, the print duties of the nozzles sandwiching the failed nozzle must be increased to a duty higher than 100%. However, the portion of the image correspondent to the failed nozzle will be filled with dots different in color from the original dots, and therefore, it is possible to keep the number of the dots to be recorded by the nozzles sandwiching the failed nozzle, the same as the original number; the print duties of the nozzles sandwiching the failed nozzle dose not need to be increased.

When an image was outputted while converting the data as described above, the image quality was excellent across virtually the entire the image, from the highlight portions to shadow portions.

(Embodiment 4)

This embodiment is different from the third embodiment in the following two points. Firstly, not only is a failed nozzles detected, but also a nozzle with a large amount of "positional deviation" is detected, and both types of nozzles are treated as a failed nozzle. Secondly, the nozzle density correction tables for the nozzles sandwiching a failed nozzle are corrected. Hereinafter, this embodiment is described about these two points.

The system used in this embodiment is the same as that in the third embodiment.

In the failed nozzle/nonuniform density detecting portion 93 in this embodiment, the following steps are sequentially carried:

1. printing of a failed nozzle/nonuniform density detection pattern;
2. detection of a failed nozzle/nonuniform density;
3. outputting of nonuniform density pattern;
4. reading of the nonuniform density pattern;
5. printing density calculation for each nozzle; and
6. density ratio data calculation for each nozzle.

Figure 10:
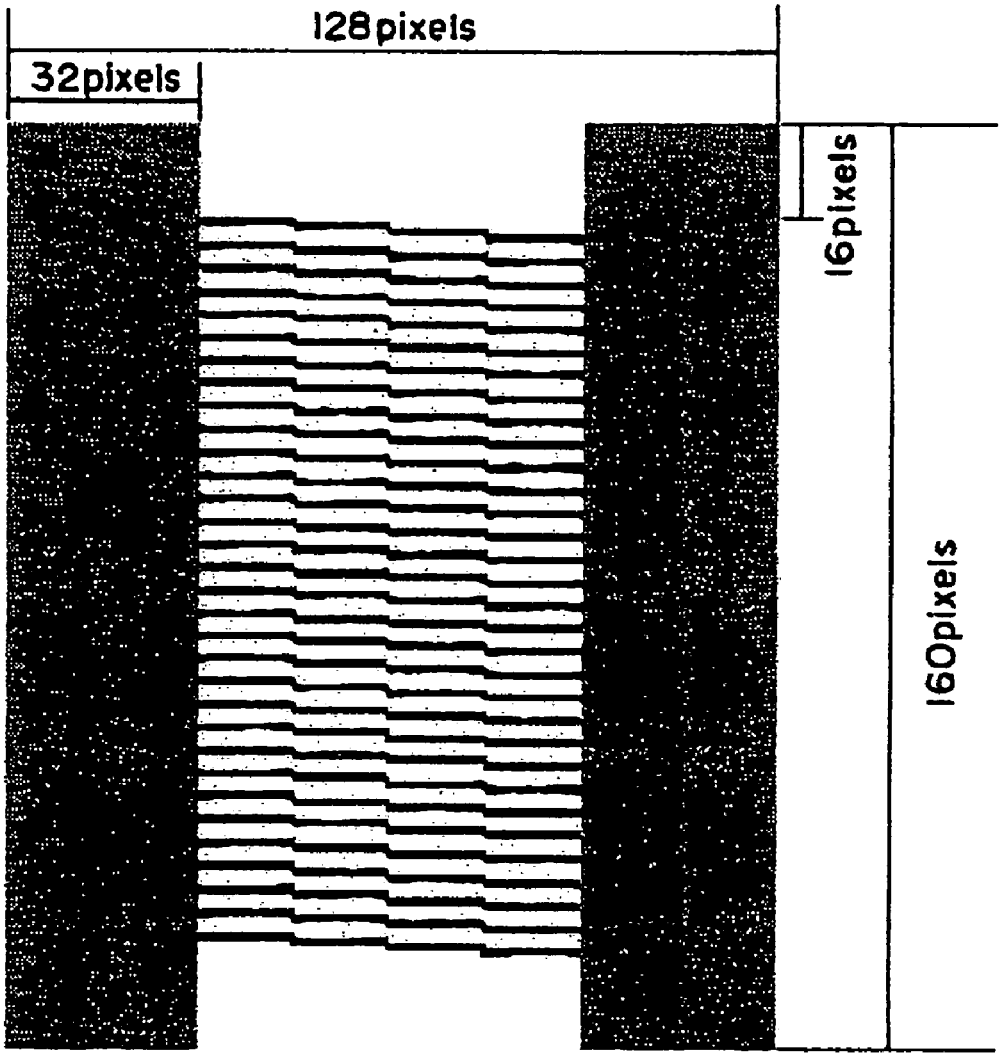
FIG. 10 is a drawing of an example of a pattern for testing the ejection performance of each nozzle, the center portion of which is filled with a plurality of stair-like lines.

The type of a failed nozzle/nonuniform density detection pattern printed first does not need to be limited to the above described one. In this embodiment, the test pattern shown in FIG. 10 is used, the center portion of which is filled with a plurality of stair-like lines, and the left and right portions of which are recorded in 50% halftone. The left and right portions of this test pattern are used to determine the overall positions of the nozzles as in the first embodiment, and the center portion of the test pattern, or the portion filled with the stair-like lines, is used to match each nozzle with the position of the dot formed thereby. The data obtained through the reading of the portion of the test image filled with the stair-like lines are used to compared the position of the maximum value to the nozzle position.

In this embodiment, the sampling in the reading of the chart is carried out in the same manner as that in the reading of the recording density. If position of a given nozzle does not corresponds to the position of the maximum value, it is determined that this nozzle has failed to eject or is large in "positional deviation", and #3 correction table is assigned to this nozzle, and #32 correction table is assigned to the other nozzles, and the next step is taken.

Next, the failed nozzle, and the nozzle with a large "positional deviation," are not used for recording. In other words, the nonuniform density reading pattern in the third embodiment is outputted using the correction tables obtained in the immediately preceding step. Then, the reading of nonuniform density, print density calculation for each nozzle, calculation of density ratio data for each nozzle are done.

As is evident from the above description of this embodiment, when the compensation method in this embodiment is employed, it takes a slightly more time. However, in this embodiment, not only is a failed nozzle detected, but also a nozzle with a large amount of "positional deviation" is detected, and therefore, much more precise compensation can be made.

Next, the process carried out by the data converting portion 94 will be described.

The density ratio data d(i) for each nozzle are read into the correction table computation circuit 136 shown in FIG. 23, and a density correction table is created for each nozzle. The manner in which the table is created is basically the same as in the third embodiment, except that in this embodiment, the following corrective process is added.

Figure 11:
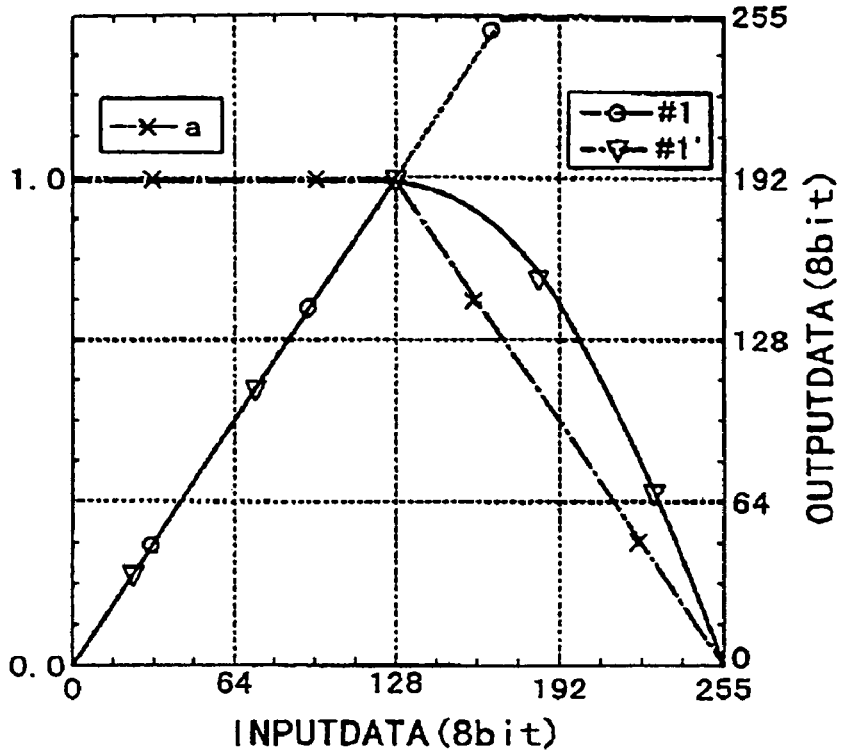

That is, as #0 density correction table is set for a failed nozzle, the density correction tables for the nozzles sandwiching the failed nozzle are modified; they are multiplied by the coefficient represented by the line a in FIG. 11. Then, the results of this multiplication are used as the density correction tables for the nozzles sandwiching the failed nozzle.

For example, when a nozzle immediately adjacent to a nozzle with #1 correction table has failed, the correction table of the nozzle with #1 correction table is modified from #1 correction table into #1' correction table.

Figure 12:
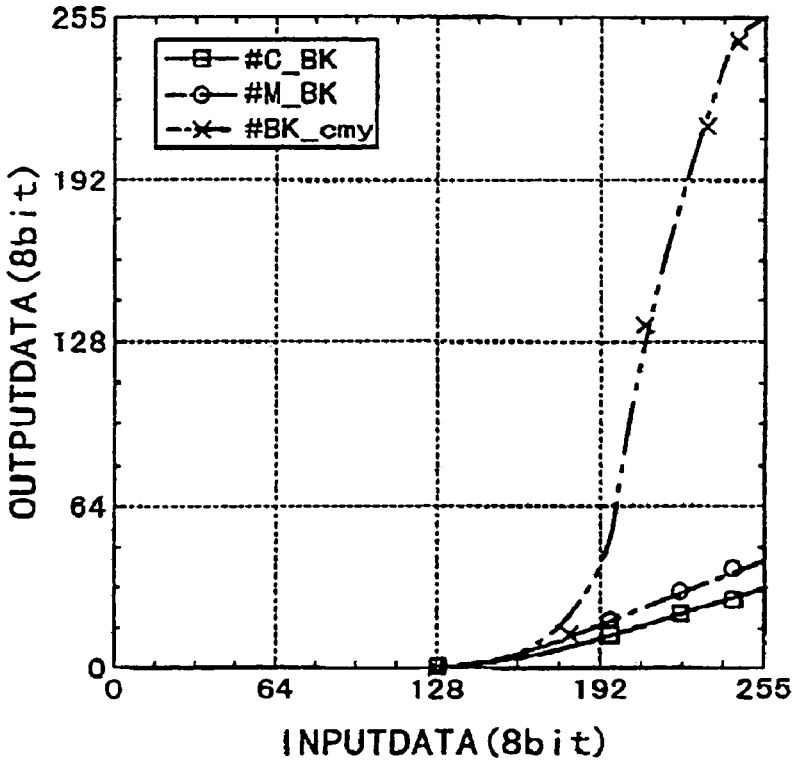
FIG. 12 is a graph of an example of a compensation table used for compensating for a bad nozzle with the use of a nozzle different in color from the bad nozzle.

As described above, in this embodiment, after the correction of the density correction table, data converting process is carried out using the table for the compensation with the use of different color, shown in FIG. 12.

In this embodiment, conceptually, when recording the highlight portion of an image, the compensation is mainly made by head shading, and when recording the shadow portion of an image, the compensation is mainly made by filling the portion of the image correspondent to a failed nozzle, with dots different in color from the original dots.

When an image is outputted after converting the data as described, image quality was excellent across virtually the entirety of the image.

The present invention is very effective when used with an ink jet recording system, in particular, when used with an ink jet recording head which comprises a means for generating thermal energy (for example, electrothermal transducer, or a laser) used for ejecting ink, and in which the state of ink is changed by the thermal energy, and also a recording apparatus employing such an ink jet recording head. This is due to the fact that according to such a recording system, recording can be made at high density, and a highly precise image can be formed.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth, and this application is intended to cover such modifications or changes as may come within the purposes of the improvements or the scope of the following claims.

What is claimed is:

1. A recording apparatus for forming a color image on a recording material using a recording head having a plurality of recording elements, said apparatus comprising:

a recording head driving means for driving the recording elements of said recording head in accordance with image data to form an image on the recording material; and a supplementing means for effecting supplementation recording with a recording element for black color recording, for a recording position corresponding to a non-operating recording element among the recording elements for non-black color recording, wherein said supplementing means corrects the image data corresponding to the non-operating recording element in accordance with a color corresponding to the non-operating recording element and effects the supplementation recording on the basis of the corrected image data using the recording element for black color recording.

2. The apparatus according to claim 1, wherein said supplementing means comprises a correcting means for correcting the image data corresponding to the non-operating recording element in accordance with a color indicated by the image data, and said supplementing means effects the recording on the basis of the image data corrected by said correcting means.

3. A recording method for forming a color image on a recording material using a recording head having a plurality of recording elements, said method comprising the steps of:

recording an image on the recording material by driving a plurality of recording elements of the recording head in accordance with image data; and effecting supplementation recording with a recording element for black color recording, for a recording position corresponding to a non-operating recording element among the recording elements for non-black color recordings, wherein said supplementation recording effecting step corrects the image data corresponding to the non-operating recording element in accordance with a color corresponding to the non-operating recording element and effects the supplementation recording on the basis of the corrected image data using the recording element for black color recording.

4. The method according to claim 3, wherein said step of effecting supplementation recording comprises a correcting step, of correcting the image data corresponding to the non-operating recording element in accordance with a color indicated by the image data, and said step of effecting supplementation recording includes effecting the recording on the basis of the image data corrected in said correcting step.

5. The method according to claim 3, wherein the non-operating recording element comprises a recording element which has become incapable of performing a recording operation.

6. The method according to claim 3, wherein said recording head comprises a plurality of nozzles, and wherein the ink is ejected from the plurality of nozzles by driving the recording element.

* * * * *

UNITED STATES PATENT AND TRADEMARK OFFICE

CERTIFICATE OF CORRECTION

PATENT NO. : 7,168,782 B2
APPLICATION NO. : 11/104604
DATED : January 30, 2007
INVENTOR(S) : Noribumi Koitabashi et al.

It is certified that error appears in the above-identified patent and that said Letters Patent is hereby corrected as shown below:

ON THE TITLE PAGE [75]:

Inventors, "Masataka Yashima, Kita-ku (JP);" should read --Masataka Yashima, Tokyo (JP);--.

ON THE TITLE PAGE [57] ABSTRACT:

Line 12, "record" should read --recorded--.

SHEET 5:

Fig. 5, "INPUTDATA" should read --INPUT DATA--; and
Fig. 6, "INPUTDATA" should read --INPUT DATA-- and "OUTPUTDATA" should read --OUTPUT DATA--.

Figure 8:
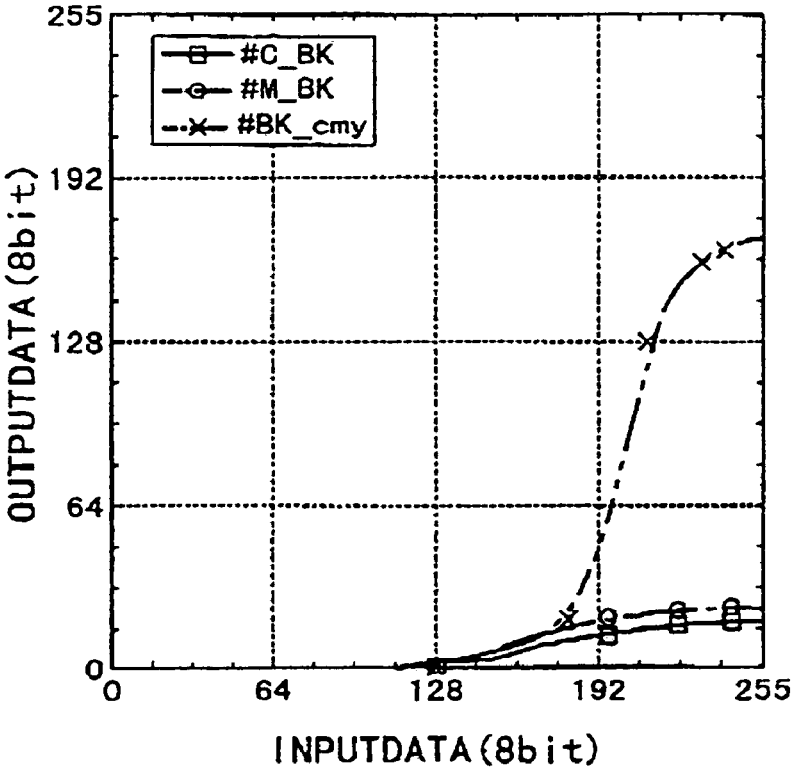
FIG. 8 is a graph showing the tables used for compensating for a bad nozzle with the use of a nozzle different in ink color from the bad nozzle.

SHEET 6:

Fig. 7, "OUTPUTDATA" should read --OUTPUT DATA-- and "INPUTDATA" should read --INPUT DATA--; and
Fig. 8, "INPUTDATA" should read --INPUT DATA-- and "OUTPUTDATA" should read --OUTPUT DATA--.

SHEET 9:

Fig. 11, "OUTPUTDATA" should read --OUTPUT DATA-- and "INPUTDATA" should read --INPUT DATA--; and
Fig. 12, "INPUTDATA" should read --INPUT DATA-- and "OUTPUTDATA" should read --OUTPUT DATA--.

SHEET 11:

Fig. 14, "166PIXELS" should read --166 PIXELS--.

SHEET 23:

Fig. 29B, "DENITY" should read --DENSITY--.

UNITED STATES PATENT AND TRADEMARK OFFICE

CERTIFICATE OF CORRECTION

PATENT NO. : 7,168,782 B2
APPLICATION NO. : 11/104604
DATED : January 30, 2007
INVENTOR(S) : Noribumi Koitabashi et al.

It is certified that error appears in the above-identified patent and that said Letters Patent is hereby corrected as shown below:

COLUMN 1:

Line 11, “relate” should read --relates--; and
Line 13, “element” should read --elements-- and “predetermine” should read --predetermine--.

COLUMN 2:

Line 24, “give” should read --given--; and
Line 33, “bade” should read --bad--.

COLUMN 3:

Line 2, “record” should read --recorded--.

COLUMN 4:

Line 48, “image” should read --image. ¶--; and
Line 67, “bade” should read --bad--.

COLUMN 5:

Line 4, “flow chart” should read --flowchart--;
Line 22, delete “pi-inter”; and
Line 35, “out” should read --output--.

COLUMN 6:

Line 17, “while” should read --white--;
Line 25, “records” should read --record--; and
Line 41, “match” should read --matched--.

COLUMN 7:

Line 37, “misting” should read --missing--; and
Line 60, “FIG. 1.” should read --FIG. 1A--.

COLUMN 8:

Line 11, “strip b:” should read --strip b;--.

UNITED STATES PATENT AND TRADEMARK OFFICE

CERTIFICATE OF CORRECTION

PATENT NO. : 7,168,782 B2
APPLICATION NO. : 11/104604
DATED : January 30, 2007
INVENTOR(S) : Noribumi Koitabashi et al.

It is certified that error appears in the above-identified patent and that said Letters Patent is hereby corrected as shown below:

COLUMN 9:

Line 12, “above described” should read --above-described--; and
Line 24, “on” should read --on a--.

COLUMN 10:

Line 7, “ink. ¶” should read --ink.--; and
Line 15, “Ink” should read --ink--.

COLUMN 11:

Line 23, “is” should read --are--;
Line 26, “is” should read --are--;
Line 36, delete “will”; and
Line 39, “nozzle” should read --nozzles--.

COLUMN 12:

Line 6, “is” should read --are--;
Line 26, “(50%).” should read --(50%),--; and
Line 49, “above described” should read --above-described--.

COLUMN 13:

Line 8, “above described” should read --above-described--.
Line 15, “above described” should read --above-described--;
Line 44, “nozzles” should read --nozzle--;
Line 47, “nozzles” should read --nozzle--; and
Line 55, “(76%)3” should read --(76B%),--.

COLUMN 14:

Line 2, “time” should read --times--;
Line 18, “to” should read --of--; and
Line 25, “With” should read --with--.

UNITED STATES PATENT AND TRADEMARK OFFICE

CERTIFICATE OF CORRECTION

PATENT NO. : 7,168,782 B2
APPLICATION NO. : 11/104604
DATED : January 30, 2007
INVENTOR(S) : Noribumi Koitabashi et al.

It is certified that error appears in the above-identified patent and that said Letters Patent is hereby corrected as shown below:

COLUMN 15:

Line 19, “8.128 wide” should read --8.128 mm wide--; and
Line 60, “ling” (both occasions) should read --line--.

COLUMN 16:

Line 11, “printer” should read --printer.--;
Line 40, “Is” should read --is--; and
Line 56, “above described” should read --above-described--.

COLUMN 17:

Line 13, “Images” should read --image--.

COLUMN 18:

Line 42, “patter” should read --pattern--;
Line 56, “follows” should read --follows.--; and
Line 63, “nozzle,” should read --nozzles,--.

COLUMN 19:

Line 43, delete “the” (first occurrence);
Line 58, “above described” should read --above-described--; and
Line 59, “above described” should read --above-described--.

COLUMN 21:

Line 13, “which” should read --which the--;
Line 25, “eve(i): d(i) = aver” should read --ave (i): d(i) = ave--;
Line 28, “process” should read --processed--;
Line 61, “above described” should read --above-described--; and
Line 63, “nozzle.” should read --nozzles.--.

UNITED STATES PATENT AND TRADEMARK OFFICE

CERTIFICATE OF CORRECTION

PATENT NO. : 7,168,782 B2
APPLICATION NO. : 11/104604
DATED : January 30, 2007
INVENTOR(S) : Noribumi Koitabashi et al.

It is certified that error appears in the above-identified patent and that said Letters Patent is hereby corrected as shown below:

COLUMN 22:

Line 1, “column” should read --columns--;
Line 2, “above” should read --above- --;
Line 17, “above described” should read --above-described--;
Line 37, “Is” should read --is--; and
Line 44, “Bk-cmy” should read --#Bk-cmy--.

COLUMN 23:

Line 3, “represented” should read --represented by--;
Line 4, “these,” should read --these--; and
Line 51, “modification. ¶” should read --modification.--.

COLUMN 24:

Line 1, “above described” should read --above-described--;
Line 5, “above described” should read --above-described--;
Line 8, “stared” should read --stared at--;
Line 54, “th” (first occurrence) should read --the--; and
Line 55, “ate” should read --are--.

COLUMN 25:

Line 2, “toner” should read --tone--;
Line 5, “toner” should read --tone--;
Line 14, “give” should read --given--;
Line 39, “c(“ should read --c--;
Line 40, “P” should read --d--; and
Line 43, “becomes” should read --become--.

COLUMN 26:

Line 42, “y conversion” should read --γ-conversion--; and
Line 45, “above described” should read --above-described--.

UNITED STATES PATENT AND TRADEMARK OFFICE

CERTIFICATE OF CORRECTION

PATENT NO. : 7,168,782 B2
APPLICATION NO. : 11/104604
DATED : January 30, 2007
INVENTOR(S) : Noribumi Koitabashi et al.

It is certified that error appears in the above-identified patent and that said Letters Patent is hereby corrected as shown below:

COLUMN 28:

Line 10, "If" should read --if--;
Line 35, "dose" should read --do--;
Line 53, "carried:" should read --carried out:--; and
Line 63, "above" should read --above- --.

COLUMN 29:

Line 12, "corresponds" should read --correspond--.

COLUMN 30:

Line 29, "is" should read --in--;
Line 45, "Laid Open" should read --Laid-Open--; and
Line 59, "head" should read --heads--.

COLUMN 31:

Line 11, "variation of the recording head mountable" should read --variations of the mountable recording head--; and
Line 29, "is" should read --in--.

COLUMN 32:

Line 36, "recordings," should read --recording,--.

Signed and Sealed this

Eleventh Day of March, 2008

JON W. DUDAS
*Director of the United States Patent and Trademark Office*